US011730643B2

(12) United States Patent
Holicov et al.

(10) Patent No.: US 11,730,643 B2
(45) Date of Patent: Aug. 22, 2023

(54) WHEELCHAIR LIFT SYSTEMS

(71) Applicant: ROXANA DEVELOPMENTS LIMITED, Whitstable (GB)

(72) Inventors: Gabriel Alexandru Holicov, Iasi (RO); Valentino Rasini, Suzzara Mantova (IT)

(73) Assignee: ROXANA DEVELOPMENTS LIMITED, Whitstable (GB)

( * ) Notice: Subject to any disclaimer, the term of this patent is extended or adjusted under 35 U.S.C. 154(b) by 321 days.

(21) Appl. No.: 17/083,530

(22) Filed: Oct. 29, 2020

(65) Prior Publication Data

US 2021/0128373 A1 May 6, 2021

(30) Foreign Application Priority Data

Oct. 31, 2019 (GB) ..... 1915813

(51) Int. Cl.
*A61G 3/06* (2006.01)
*A61G 3/08* (2006.01)
(Continued)

(52) U.S. Cl.
CPC ..... *A61G 3/062* (2013.01); *A61G 3/02* (2013.01); *A61G 3/0808* (2013.01); *F15B 15/20* (2013.01); *A61G 5/10* (2013.01)

(58) Field of Classification Search
CPC ..... A61G 3/062; A61G 3/0808
See application file for complete search history.

(56) References Cited

U.S. PATENT DOCUMENTS

2001/0036397 A1 11/2001 Pierrou
2005/0238471 A1 10/2005 Ablabutyan et al.
(Continued)

FOREIGN PATENT DOCUMENTS

EP 0032457 A2 7/1981
EP 0955029 A2 11/1999
(Continued)

OTHER PUBLICATIONS

Search Report issued in Great Britain Application No. GB1915813.8 dated Feb. 28, 2020; 4 pages.
(Continued)

*Primary Examiner* — Saul Rodriguez
*Assistant Examiner* — Willie W Berry, Jr.
(74) *Attorney, Agent, or Firm* — Wegman Hessler

(57) ABSTRACT

A wheelchair lift system for a vehicle comprises: a platform for accommodating a wheelchair; a lifting arm; a hydraulic circuit including a hydraulic actuator arranged to act on the lifting arm to raise and lower the platform; a barrier mounted on the platform and pivotable between a raised position and a lowered position; a plurality of sensors each arranged to generate a sensor output; a user input device arranged to generate control signals to control operation of the lift; and a control unit. The control unit is arranged to receive the control signals and to receive the sensor output from each of the sensors and to control the hydraulic circuit thereby to control of the lift to perform a number of different operations. The control unit is also operable in a fully operational mode and a safety mode and is arranged to perform a plurality of checks on the sensor outputs, and to record a result of each of the checks, and to switch between the fully operational mode and the safety mode based on the results.

14 Claims, 13 Drawing Sheets

(51) Int. Cl.

| | |
|---|---|
| ***F15B 15/20*** | (2006.01) |
| ***A61G 3/02*** | (2006.01) |
| *A61G 5/10* | (2006.01) |

(56) References Cited

U.S. PATENT DOCUMENTS

| | | | | |
|---|---|---|---|---|
| 2006/0233632 | A1 | 10/2006 | Hayes et al. | |
| 2007/0086879 | A1* | 4/2007 | Goodrich | H02H 7/0851 414/539 |
| 2017/0252234 | A1 | 9/2017 | Budd, II et al. | |

FOREIGN PATENT DOCUMENTS

| | | | |
|---|---|---|---|
| EP | 1478317 | A2 | 11/2004 |
| WO | 03065960 | A2 | 8/2003 |
| WO | 2009134837 | A1 | 11/2009 |

OTHER PUBLICATIONS

Search Report issued in Great Britain Application No. GB1915813.8 dated Aug. 26, 2020; 2 pages.
Search Report issued in Great Britain Application No. 1915813.8 dated Apr. 21, 2023, 5 pages.

* cited by examiner

WHEELCHAIR LIFT SYSTEMS

CROSS REFERENCE TO RELATED APPLICATIONS

This application claims the priority filing benefit of Great Britain Patent Application No. 1915813.8 filed Oct. 31, 2019, which is incorporated herein by reference in its entirety.

FIELD OF THE INVENTION

The invention relates to vehicle-mounted wheelchair lifts, and in particular to control and diagnostic systems for such lifts.

BACKGROUND

Foldable wheelchair lifts provide a moveable platform upon which a wheelchair may be raised and lowered between ground level and a level at which the wheelchair may be wheeled into or out from the vehicle. Such lifts are generally mounted on or inside the vehicle itself and are deployed out from a door in the side or the rear of the vehicle when needed, for example using a hydraulic actuating mechanism.

Wheelchair lifts are generally hydraulically operated and include a large number of mechanical components and with ever improving safety standards it is increasingly important for lifts to be installed and set up correctly and maintained in good working order to ensure the safety of users of the lifts.

SUMMARY OF THE INVENTION

According to a first aspect of the invention, there is provided a wheelchair lift system for a vehicle the system comprising: a platform for accommodating a wheelchair; a lifting arm; a hydraulic circuit including a hydraulic actuator arranged to act on the lifting arm to raise and lower the platform; a barrier mounted on the platform and pivotable between a raised position and a lowered position; a plurality of sensors each arranged to generate a sensor output; a user input device arranged to generate control signals to control operation of the lift; and a control unit; wherein the control unit is arranged to receive the control signals and to receive the sensor output from each of the sensors and to control the hydraulic circuit thereby to control of the lift to perform a number of different operations; the control unit is operable in a fully operational mode and a safety mode and is arranged to perform a plurality of checks on the sensor outputs, and to record a result of each of the checks, and to switch between the fully operational mode and the safety mode based on the results.

The control unit may be arranged to initiate a first operation of the lift in response to a first one of the control signals in both the fully operational mode and the safety mode. The control unit may be arranged to introduce a delay in performance of the operation only when the control unit is in the safety mode, i.e. not when the control unit is in the fully operational mode.

The control unit may be arranged to initiate a first operation of the lift in response to a first one of the control signals in both the fully operational mode and the safety mode, but to control the lift system to perform the operation at a first rate when in the control unit is in the fully operational mode and at a second rate when the control unit is in the safety mode, and the second rate is slower than the first rate.

The first operation may for example comprise one of: raising the lift, lowering the lift, stowing the lift, and deploying the lift.

The control unit may be arranged to default to the safety mode, for example when the lift is installed in the vehicle, or when it is first powered up, and to perform a set of checks on the sensor outputs, and only switch to the fully operational mode in response to checks indicating no system faults.

The control unit may be arranged to monitor the sensor outputs during operation of the lift in the fully operational mode, and to switch to the safety mode if the sensor outputs indicate the presence of at least one system fault.

The control unit may be arranged to store in memory, as fault record data, each detection of a system fault and the time of that detection.

One of the sensors may be a pressure sensor arranged to measure the pressure of hydraulic fluid in the hydraulic circuit.

One of the sensors may be arranged to measure the temperature of hydraulic fluid in the hydraulic circuit.

One of the sensors may be a lift height sensor arranged to measure a current height of the lift.

The control unit may be arranged to monitor the sensor signals during operation of the lift, to detect from the sensor signals the occurrence of a safety critical condition, and in response to detection of a safety critical condition, to prevent movement of the lift.

After detection of a safety critical condition, the control unit may be arranged to enable movement of the lift only after receiving a further control signal from the user input and detecting an absence of the safety critical condition.

The safety critical condition may comprise one of: the position of a barrier of the lift, the presence of a load on the floor of the vehicle, and the presence of a load on the lift platform.

The control unit may be arranged to record in memory as safety critical condition data each occurrence of a safety critical condition and the time of that occurrence.

The control unit may be arranged to define a plurality of states of the lift system and to determine which of the states the lift is in depending on the sensor outputs and control inputs, to record the current state of the lift system, and to record in memory as state data each change of state of the lift and the time of each such change of state.

The control unit may be arranged to record in memory a count of operational cycles of the lift, to detect from the sensor outputs each time that the lift completes an operational cycle, and in response to completion of an operational cycle to update the recorded count of lift cycles.

The control unit may be arranged to switch to the safety mode in response to the recorded count reaching a predetermined number.

The wheelchair lift system may further comprise a terminal device. The control unit and the terminal device may be arranged to establish a wireless communication link between them. The terminal device may be arranged to receive from the control unit data stored in memory by the control unit. The terminal device may be arranged to transmit control signals to the control unit. The terminal device may thereby act as the user input device.

The terminal device may be arranged to receive the fault record data from the control unit. The terminal device may be arranged to generate based on the fault record data a display indicating the presence or absence of recorded faults.

The terminal device may be arranged to transmit to the control unit a control input arranged to switch the control unit from the safety mode to the fully operational mode.

The terminal device may be arranged to transmit to the control unit a control settings input arranged to change at least one operational setting of the lift system. The operational setting may comprise a rate of movement of the lift, for example a hydraulic pump speed, or the volume of an alarm such as a buzzer or siren, or the tolerance on the value of one or more of the sensor outputs which are checked by the control unit to determine the occurrence of a fault or a safety critical condition.

The terminal device may be arranged to establish wireless communication with at least one further control unit of at least one further wheelchair lift to enable a user to monitor and/or operate a plurality of wheelchair lifts using a single terminal device.

The invention further provides a wheelchair lift system for a vehicle, the system comprising: a platform for accommodating a wheelchair; a lifting arm; a hydraulic circuit including a hydraulic actuator arranged to act on the lifting arm to raise and lower the platform; a user input device arranged to generate a stow signal; a hydraulic pressure sensor arranged to output a pressure sensor signal indicative of the pressure in the hydraulic circuit; a lift height sensor arranged to output a lift height signal indicative of the height of the lift platform; and a control unit; wherein the control unit is arranged to receive the stow signal and, in response to the stow signal, to control the hydraulic circuit thereby to move the lift platform from an operational position to a stowed position, and the control unit is arranged to receive the pressure sensor signal and to determine therefrom when the hydraulic pressure exceeds a predetermined threshold, and if it determines that the hydraulic pressure exceeds the threshold to stop movement of the lift platform towards the stowed position and to set a flag preventing movement of the lift platform towards the stowed position, and to clear the flag in response to determining from the lift height signal that the lift platform has returned to a predetermined level.

The predetermined level may be a vehicle floor level. The predetermined level may be a level at which a wheelchair can be wheeled between a floor of the vehicle and the lift platform.

The invention further provides a wheelchair lift system for a vehicle, the system comprising: a platform for accommodating a wheelchair; a lifting arm; a hydraulic circuit including a hydraulic actuator arranged to act on the lifting arm to raise and lower the platform; a barrier mounted on the platform and pivotable between a raised position and a lowered position; a plurality of sensors each arranged to generate a sensor output; a user input device arranged to generate control signals to control operation of the lift; a control unit; and a terminal device; wherein the control unit and the terminal device are arranged to establish a wireless communication link between them, the terminal device is arranged to receive from the control unit fault data stored in memory by the control unit and indicative of a fault in the lift system, and the terminal device comprises a display and may be arranged to control the display to indicate to a user the presence of the fault in the lift system.

The terminal unit may be arranged to establish wireless communication with at least one further control unit of at least one further lift system. The further lift system may comprise a lift and a control unit. For example the further lift system may comprise all of the features of the first lift system but may not include a further terminal device. The terminal device may be able to control its display so as to indicate the presence of a fault in any one of a plurality of lift systems.

The lift assembly may further comprise, in any workable combination, any one or more features of the preferred embodiments of the invention which are shown by way of example only in the accompanying drawings.

BRIEF DESCRIPTION OF THE FIGURES

FIGS. 5B and 5B form a flow diagram of operation of the system of FIGS. 1 to 4 when the system is powered on;

DETAILED DESCRIPTION

Figure 1:
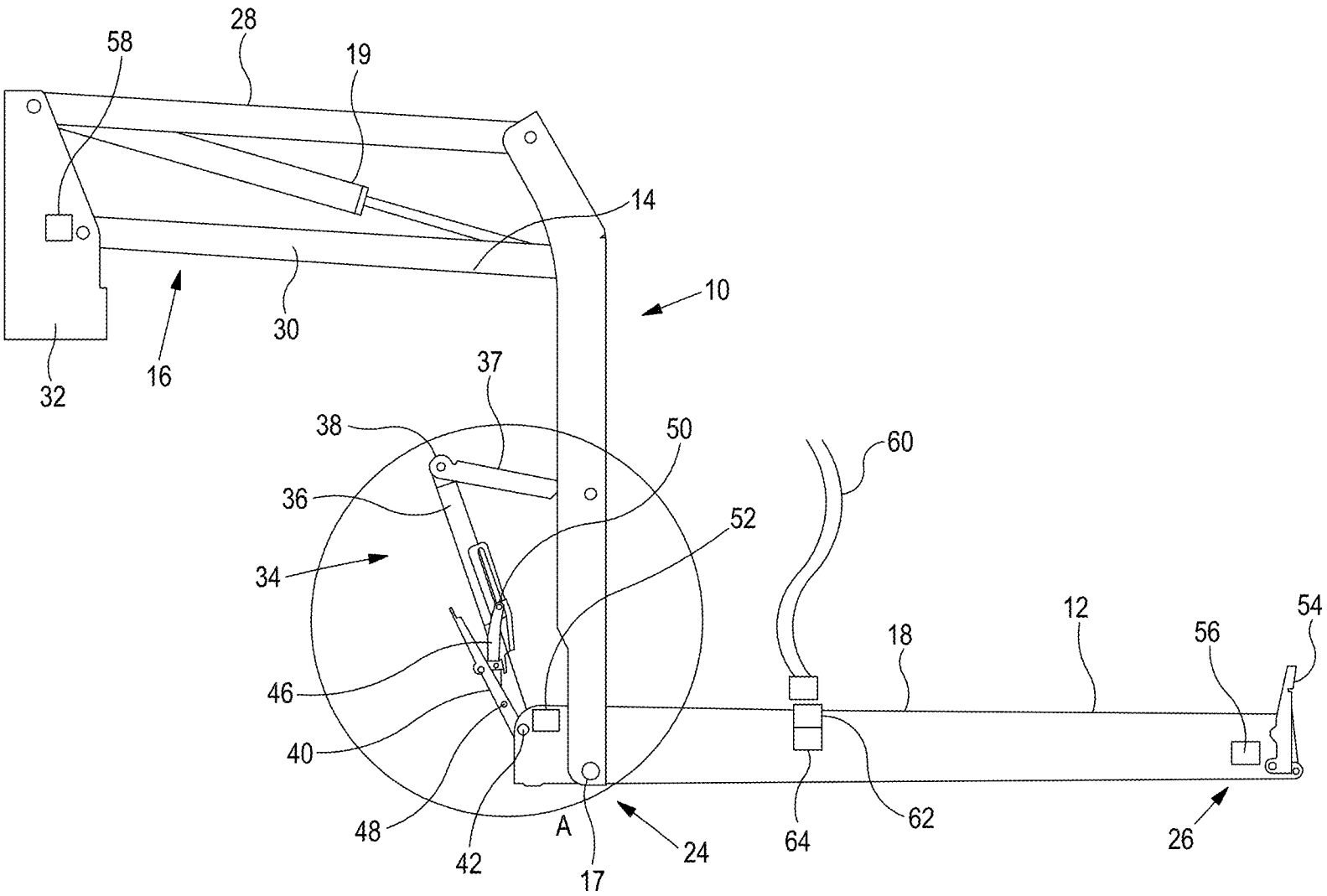
FIG. 1 is a side view of a wheelchair lift forming part of a system according to an embodiment of the invention in a lowered position.
Figure 2:
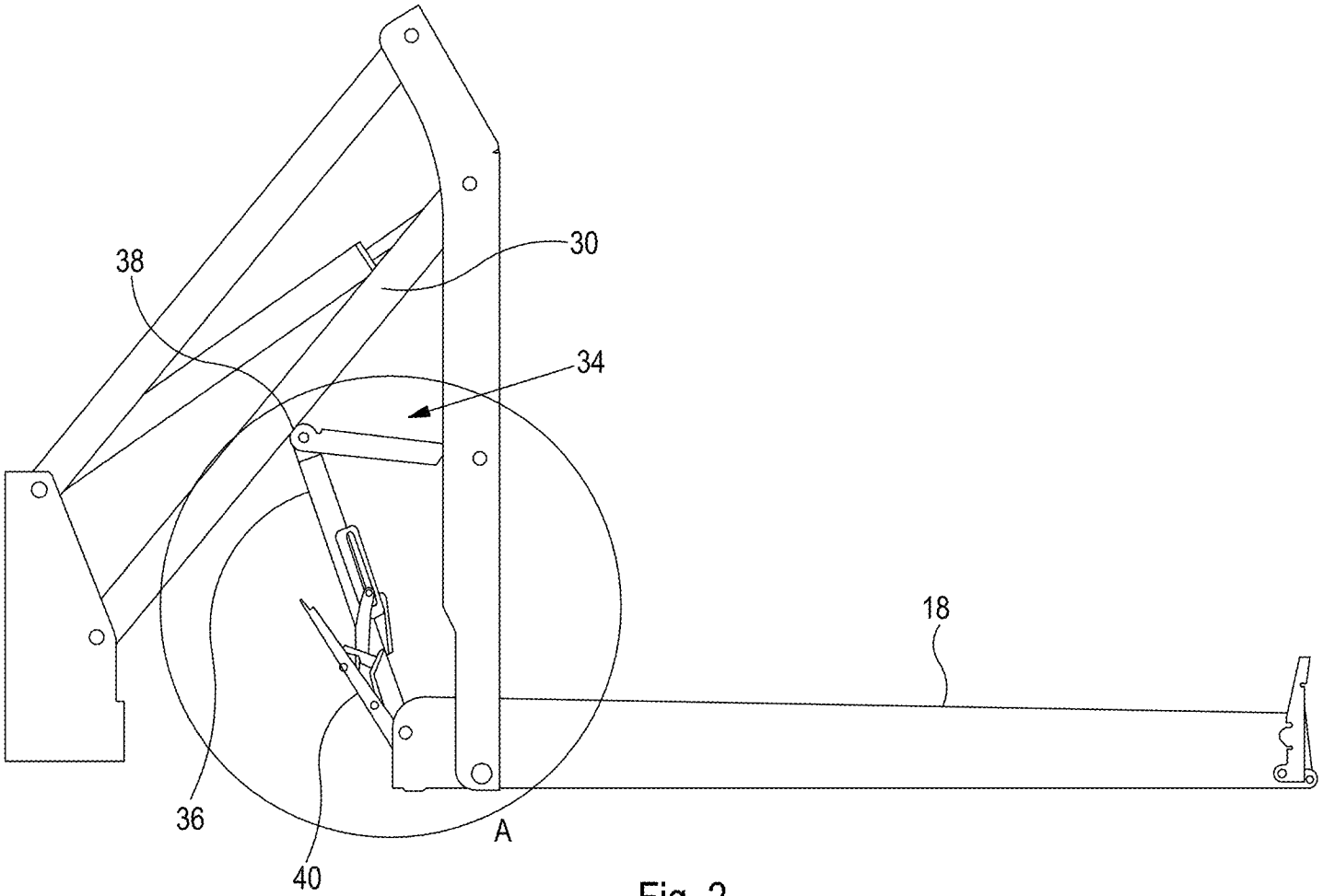
FIG. 2 is a side view of the wheelchair lift of FIG. 1 in an intermediate position.
Figure 3:
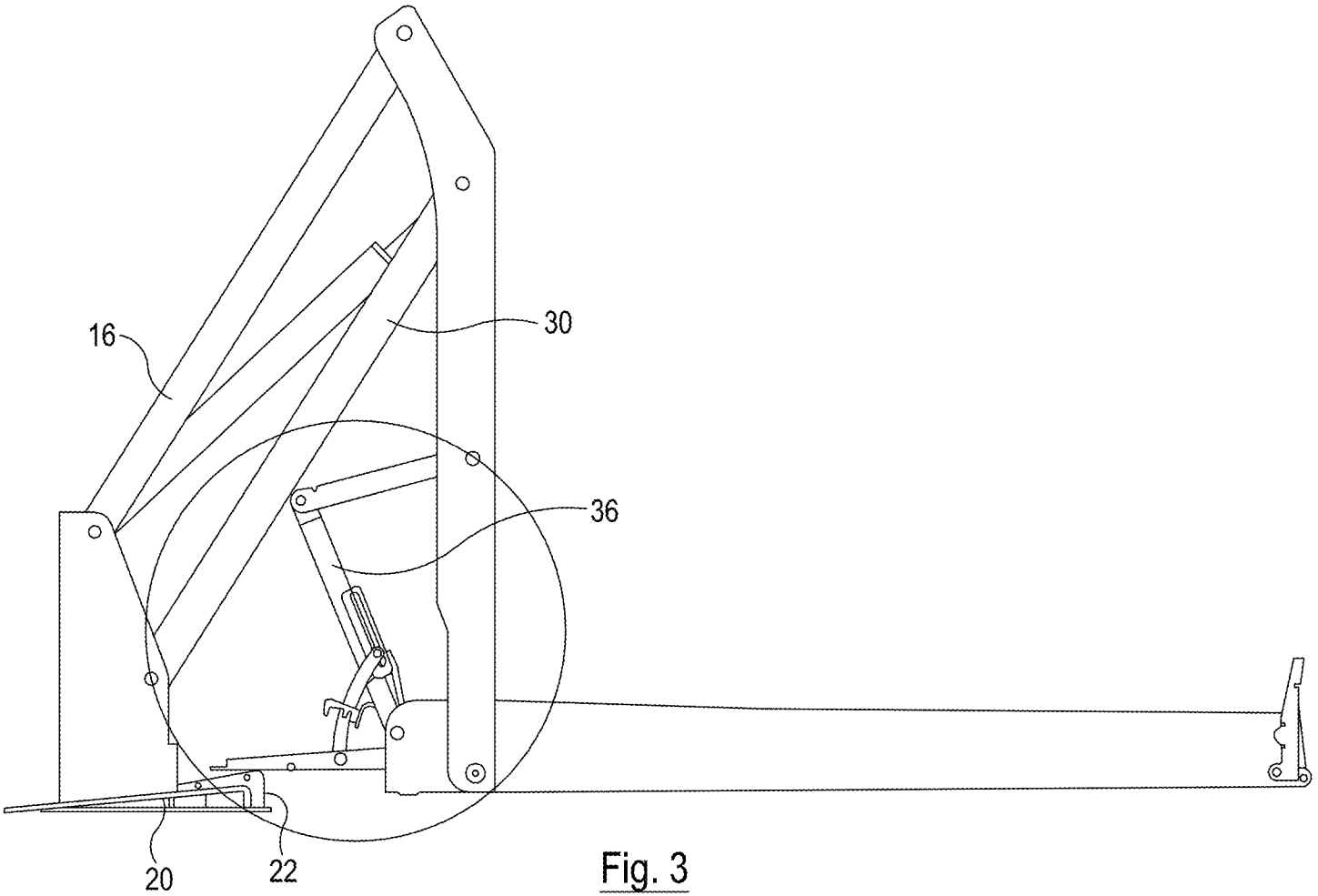
FIG. 3 is a side view of the wheelchair lift of FIG. 1 in a raised position.

Referring to FIGS. 1 to 3 a wheelchair lift 10 comprises a lift platform assembly 12, a pair of support arms 14 which are arranged substantially vertically with the platform 12 supported between their lower ends, and a pair of lifting assemblies 16, each connecting the upper end of one of the support arms 14 to a respective mounting turret 32 which in turn is mounted on the floor of a vehicle forming a base for the lift. The platform assembly 12 is pivotably mounted on each of the support arms 14 so that it can pivot about a pivot axis 17 between a generally horizontal deployed position as shown in the figures and a generally vertical stowed position.

The lifting assemblies 16 are each hydraulically actuated by a hydraulic strut 19 to move the lift 10 between a deployed configuration, in which the platform assembly 12 is arranged to provide a substantially horizontal platform 18 upon which a wheelchair may be accommodated, and a stowed configuration (not shown), in which the platform assembly 12 is folded away and is stowed within the vehicle upon which the wheelchair lift 10 is mounted in a substantially vertical arrangement. In the deployed configuration, the platform assembly 12 is movable between a lowered position, as shown in FIG. 1, in which the platform assembly 12 rests on, or is in close proximity to, the ground and in which a wheelchair can be wheeled between the ground and the platform 18, and a raised position, as shown in FIG. 3, in which the platform assembly 12 is approximately level with the floor 20 of the vehicle and in which the wheelchair may be wheeled between the platform 18 and the floor 20 of the vehicle. A floor loading sensor 22 is provided in or on the vehicle floor, for example in the form of a safety mat, which can detect the presence of a person on the vehicle floor.

Typically, the wheelchair lift 10 will be mounted in a vehicle, such as a minibus, to raise and lower a wheelchair and its occupant between the ground and the inside of the vehicle. The most common arrangement is for the wheelchair lift 10 to be mounted at the rear of the vehicle so that it may be deployed through doors on the back of the vehicle. Accordingly, the frame of reference used in the following description assumes such a configuration. For example, the right and left sides of the lift 10 are those that face the left and right sides of the vehicle when looking forwards. Of course, other mounting configurations are possible, for example so that the lift 10 deploys out from the side of the vehicle. The "front" or "inboard" side 24 of the lift 10 is therefore the side that faces into the vehicle and the "rear" or "outboard" side 26 of the lift 10 is the side that faces out of the vehicle, i.e. in the direction in which the platform assembly 12 extends away from the support arms 14 when the lift 10 is in the deployed configurations.

The lift 10 typically comprises right and left lifting assemblies 16. However, it is possible for the wheelchair lift 10 to comprise only a single lifting assembly 16 and associated support arm 14. For example, only the left or right lifting assembly 16 need be present. However, having both left and right lifting assemblies 16 improves the stability of the lift 10. Each lifting assembly 16 may comprise an upper lifting arm 28 and a lower lifting arm 30, which are arranged substantially parallel to each other. Each of the upper 28 and lower 30 lifting arms is typically pivotably connected at its lower (inboard) end to a mounting turret 32, the upper lifting arm 28 being connected to the mounting turret 32 at a point above the lower lifting arm 30. The turret or turrets 32 therefore form at least part of a base which is mounted on the vehicle to connect the lift assembly to the vehicle. The upper (outboard) end of each of the lifting arms 28, 30 may be pivotably connected to the upper end of one of the support arms 14, again with the upper lifting arm 28 being connected to the support arm at a point above the lower lifting arm 30 so as to form a parallelogram linkage. The lifting assemblies 16 generally each comprise at least one hydraulic strut arranged to actuate the parallelogram linkage, which in turn causes the lift 10 to raise and lower between the stowed, raised, and lowered configurations.

A platform folding linkage 34 is provided on at least one side of the lift assembly. The platform folding linage may comprise a first link 36 and a second link 37. The first link 36 is pivotably connected to the inboard end of the platform 18, inboard of the pivot axis 17 and extends generally upwards from the platform. The second link 37 is pivotably connected to the upper end of the first link 36 and to the support arm 14 at a point above the pivot axis 17. A bearing surface 38 is formed on the linkage 34 at the upper end of the first link 36, which is arranged to engage with the underside of the lower lifting arm 30 as the lift is raised as will be described in more detail below. The first link 36 is formed in two parts so that the effective length of the first link 36 (i.e. the distance between the bearing surface 38 and the pivot axis of the connection between the first link 36 and the platform 18) is variable between an extended length and a contracted length. The two parts of the first link 36 are spring biased towards the extended condition, for example by means of a gas spring.

The platform assembly also comprises a bridge plate 40, which is pivotably connected to the inboard end of the platform 18 so that it can pivot about a horizontal axis 42 adjacent to the proximal (inboard) edge of the platform 12. The bridge plate 40 is movable between a lowered, substantially horizontal position and a raised, substantially vertical, position. In the lowered position it is arranged to bridge the gap between the floor of the vehicle and the inboard edge of the platform 18 when the lift 10 is in the raised configuration, as shown in FIG. 3, thereby allowing a wheelchair to be wheeled between the platform 12 and the floor of the vehicle. In its raised position the bridge plate 40 extends upwards from the inboard edge of the platform 18 to prevent the wheelchair from rolling off the inboard end of the platform 18. A bridge plate control link 46 is connected to the bridge plate by a pivoting connection 48 and to the upper part of the first link 36 by means of a sliding linkage 50, so as to control raising and lowering of the bridge plate 40.

A bridge plate sensor 52, which may for example comprise a magnetic sensor or a transducer, or any other suitable type of sensor, is arranged to sense movement of the bridge plate 40 out of its raised position. For example, as shown in FIG. 1, the bridge plate sensor 52 may be mounted on the side of the lift platform 18 and positioned so that the bridge plate is aligned with it when in the fully raised position.

A ramp or outer barrier 54 is mounted on the outboard end 26 of the platform 18 and is pivotable between a raised, substantially vertical position, as shown in FIG. 1 in which it acts as a barrier to prevent a wheelchair from rolling off the outboard end 26 of the platform, and a lowered position in which it is substantially horizontal and forms a ramp between the platform 18 and the ground. A ramp sensor 56, which again may be a magnetic sensor or a transducer, is arranged to sense when the ramp 54 is in its raised position.

A lift position sensor 58, which may be a rotary or other angle sensor, is arranged to sense the angular position of one of the lifting assemblies 16 relative to the vehicle. For example the lift position sensor may be attached to a pivot pin of one of the lifting arms 28, 30. The lift position sensor may be in the form of a potentiometer which generates an output signal the value, typically the voltage, of which is indicative of the position of the lift. The voltage may vary, for example, between zero and a maximum value. The value of the output signal may be sampled at any point in time to generate a digital value indicative of the height of the lift. During normal operation that digital value may be arranged to vary between predetermined limits, and if the value is outside those limits that may be indicative of a fault in the installation or operation of the sensor.

The lift includes a safety belt 60 which can be used to secure a wheelchair in position on the platform 18. This is fastened by means of a buckle 62, and a safety belt sensor 64 is connected to the buckle and arranged to sense whether the safety belt is secured or not.

As the lift is raised by the lifting assemblies 16 between its lowered position and an intermediate position, the platform folding linkage 34 approaches but does not contact the lower lifting arm 30, and therefore the platform 18 remains in its horizontal lowered position and the bridge plate remains latched in its raised condition.

At an intermediate position, as shown in FIG. 2, the bearing surface 38 on the platform folding linkage 34 contacts the underside of the lower lifting arm 30. Then as the lift is raised further, the upper part **36*b* of the first part of the link 36 is pushed downward relative to the lower part 36*a*, towards the platform 18**.

Further raising of the lift causes the lower lifting arm 30 to push down further on the upper part of the first link 36. This compresses the first link 36, and allows the bridge plate control link 46 to move downwards and the bridge plate 40 to lower under its own weight towards its lowered position. As the lift approaches its fully raised position it moves in an inboard direction and the bridge plate 40 continues to be lowered until it lands on the floor loading sensor 22 on the floor 20 of the vehicle. The bridge plate is then in its lowered condition in which it acts as a bridge between the lift platform 18 and the vehicle floor 20. Over the final part of movement of the lift into its fully raised position, further compression of the link 36 is accommodated by the sliding connection 50 while the bridge plate 40 remains resting on the edge 70 of the vehicle floor and the platform 18 remains in its horizontal position.

From the raised position as shown in FIG. 3, if the lifting assembly 16 is powered further upwards to move the lift to its stowed position, the lifting arms 28, 30 continue to rotate upwards about their lower ends moving the support arm 14 upwards and inboard. The first link 36 continues to be pushed downwards by the lower lifting arm 30 until it reaches the limit of its compression, and then starts to push down on the inboard end of the platform 18 thus tilting the outboard end of the platform up towards its stowed or stored position. During this movement, the sliding connection 50 allows the bridge plate 40 to remain in its lowered horizontal position while the platform 18 tilts up relative to the vehicle and the bridge plate 40. When the lift reaches its fully stored position a retaining hook is arranged to secure the lift in that stored position. If the lift is to be lowered again, the retaining hook is released as described in more detail below.

Figure 4:
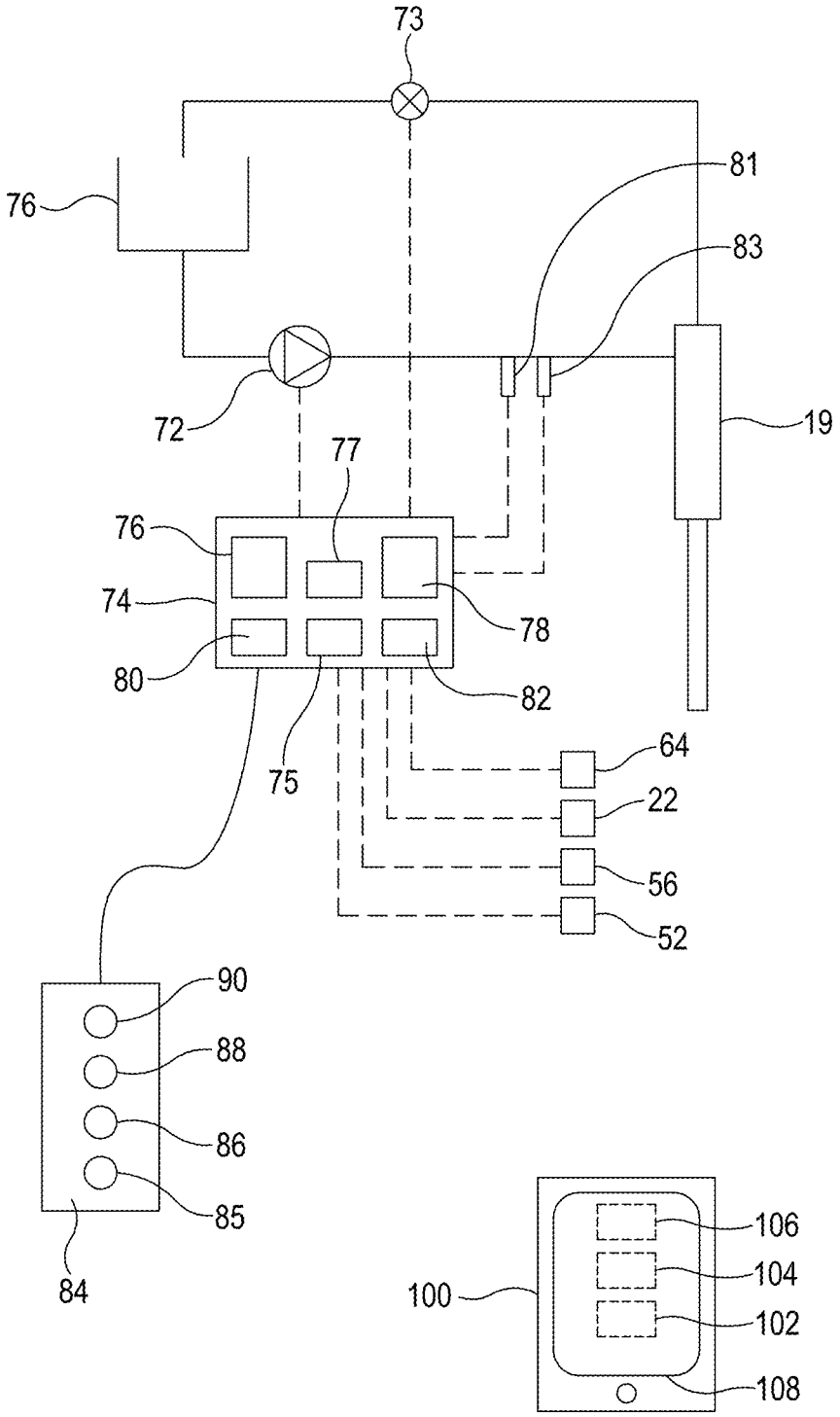
FIG. 4 is a schematic diagram of a system according to an embodiment of the invention.

Referring to FIG. 4, the hydraulic struts 19 of the lifting assemblies are powered up and down by a hydraulic pump 72 and a solenoid valve 73 under the control of an electronic control unit or ECU 74. The pump 72 is driven from the vehicle battery via a relay switch and provides pressurized fluid from a reservoir 76 to the struts 19 to raise the lift and the valves 73 can be opened to allow the lift to lower. The pump 72 may have a single operational speed, or the pump speed may be variable, for example using PWM control of the driving current to the pump, in which case the ECU may be arranged to control the speed of the pump by controlling the PWM modulator as well as turning the pump on and off. The ECU 74 comprises a display such as an LCD display 75, a processor 76, a clock 77, a memory 78 in the form of EEPROM, and an SD memory card 80. It also comprises a transceiver unit 82 which may be configured for Bluetooth wireless communication. The ECU 74 is also connected to the bridge plate detector 52 so that the control unit can determine when the bridge plate is moved out of its fully raised position, to the ramp sensor 56 so that it can detect the position of the ramp 54, to the floor loading sensor 22 so that it can detect the presence of a load on the vehicle floor from either the bridge plate 40 or a person or other load, to the lift position sensor 58 so that it can determine the position of the lift, and to the belt sensor 64 so that it can detect whether the safety belt 60 is secured or not. The hydraulic circuit further comprises a temperature sensor 81 arranged to sense the temperature of the hydraulic fluid in the hydraulic circuit and to output a temperature signal indicative of that temperature, and a pressure sensor 83 arranged to measure the pressure of the hydraulic fluid in the hydraulic circuit and to output a pressure signal indicative of that pressure. Each of these sensors 81, 83 is connected to the ECU 74 which is arranged to receive the temperature signal and the pressure signal. The pressure sensor 83 may be a simple switch arranged to detect whether the hydraulic pressure is above or below a threshold pressure thereby to determine whether the hydraulic circuit is operational or faulty, for example a fault may be a leak.

The ECU 74 is connected to a hand-held control module 84 either wirelessly or via a cable connection. The control module has four buttons, a 'deploy' button 85, a 'lower' button 86, an 'up' button 88 and a 'stow' button 90. Each of these buttons is arranged to generate a respective signal when pressed, and the ECU 74 is arranged to detect each of the signals and control the lift accordingly. The ECU is arranged to output a solenoid signal which controls operation of the solenoid valve 73 to control lowering of the lift, a relay signal which is arranged to turn the pump 72 on and off via the pump control relay, and a hook signal which is arranged to open the retaining hook to release the lift from its stored position, or release the retaining hook so that it can move into its operative position to retain the lift in its stored position. The ECU is also arranged to output a buzzer or siren control signal, which can be in one of two states, high to activate a buzzer or siren and low to de-activate the buzzer or siren. The volume of the buzzer or siren may also be variable in which case the ECU may be arranged to control the volume of the buzzer or siren as well as turning it on and off. Similarly the ECU is arranged to output a light control signal which is arranged to activate and deactivate a flashing LED warning light.

The ECU 74 is arranged to control the operation of the lift system in response to user inputs, in the form of signals from the control module 84, and to sensor signals from the various system sensors. The ECU has two modes of operation: a fully operational mode and a safety mode. In the safety mode the ECU is arranged to respond differently to at least some of the various inputs compared to operation in the fully functional mode. For example in the safety mode the ECU may be arranged to introduce a delay between receipt of a control input from the control module 84, requiring at least one of the buttons 85, 86, 88, 90 to be held for a predetermined time period before it will start the operation corresponding to the pressed button. That predetermined time period or delay may be longer than any time period that the lift system takes to respond to the pressing of the same button when operating in the fully operational mode. Alternatively or in addition it may move the lift more slowly during raising, lowering, storing or deploying of the lift when in the safety mode.

The system further comprises a terminal device 100, which may be a tablet or mobile phone device, and which comprises a processor 102, memory 104 a transceiver unit 106 which is arranged for wireless communication with the transceiver device 82 in the ECU 74, for example using Bluetooth technology, and a display screen 108, which may be a touchscreen thereby providing a user interface for the terminal device. The terminal device 100 may comprise further input buttons or a keyboard which may, in addition to the screen 108, form the user interface. It will be appreciated that other forms of user interface, such as a speech recognition system, may also form part of the user interface. The terminal device 100 has an application (app) stored on it which can be run to enable a user to adjust and control various aspects of the lift system via the user interface. The app is also arranged to establish wireless communication between the terminal device 100 and the ECU 70, and when it is paired with the ECU, to download data stored on the SD card 80 to the terminal device 100, and to analyse that data and display information about the system to a user of the terminal device 100. It is further arranged to enable a user to interact with the ECU to control operation of the ECU and the lift, for example enabling the user to input data, such as system settings, via the user interface of the terminal device 100, which are communicated directly to the ECU, and enabling the user to provide control inputs via the user interface of the terminal device which cause the terminal device to communicate those control inputs to the ECU, for example corresponding to the inputs from the buttons 85, 86, 88, 90 on the control module 84 so that a user can control the operation of the lift directly via the terminal device 100, replicating all of the functions that can be controlled from the control module 84 and which are described in more detail below.

The terminal device 100 is also arranged, when paired with the ECU, to communicate with the ECU to download regularly all of the data stored in the SD card, or other suitable memory, which records all of the operations, state changes, and sensor output values of the lift, with their associated time stamps. It is then arranged to display that data for review by a user of the terminal device 100. The terminal device is also arranged to transmit all of the data downloaded from the SD card to a central server or terminal where it can be reviewed and analysed for example by the manufacturer or supplier of the lift, or a fleet manager who is responsible for a number of lifts.

The ECU 74 is arranged to perform a number of functions. It enables the system settings to be set up and controlled from the terminal device 100 using the app, it performs a number of diagnostic functions based on data received from the various system sensors and the control module 84, and it is arranged to switch between the fully operational mode and the safety mode depending on the outcome of the diagnostic routines. In order to perform the diagnostic functions, the ECU 74 defines various different states of the lift, and records the times of each occasion on which it enters a new state. The states may for example be: stowed, floor level, lowering, ground level and lifting. It also defines two states of the safety mode; on or off. It also defines two states of the safety belt: secured or not secured. The ECU also stores the current state of the lift and the safety belt and the safety mode, as well as the current states of any other relevant components of the system, so that it can determine how to operate the lift in response to the various inputs it receives. The ECU includes a pressure sensor flag which can be set to high (1) or low (0). If the flag is set to 1 then this is used to prevent the lift from being stowed as will be described in more detail below.

Figure 5A:
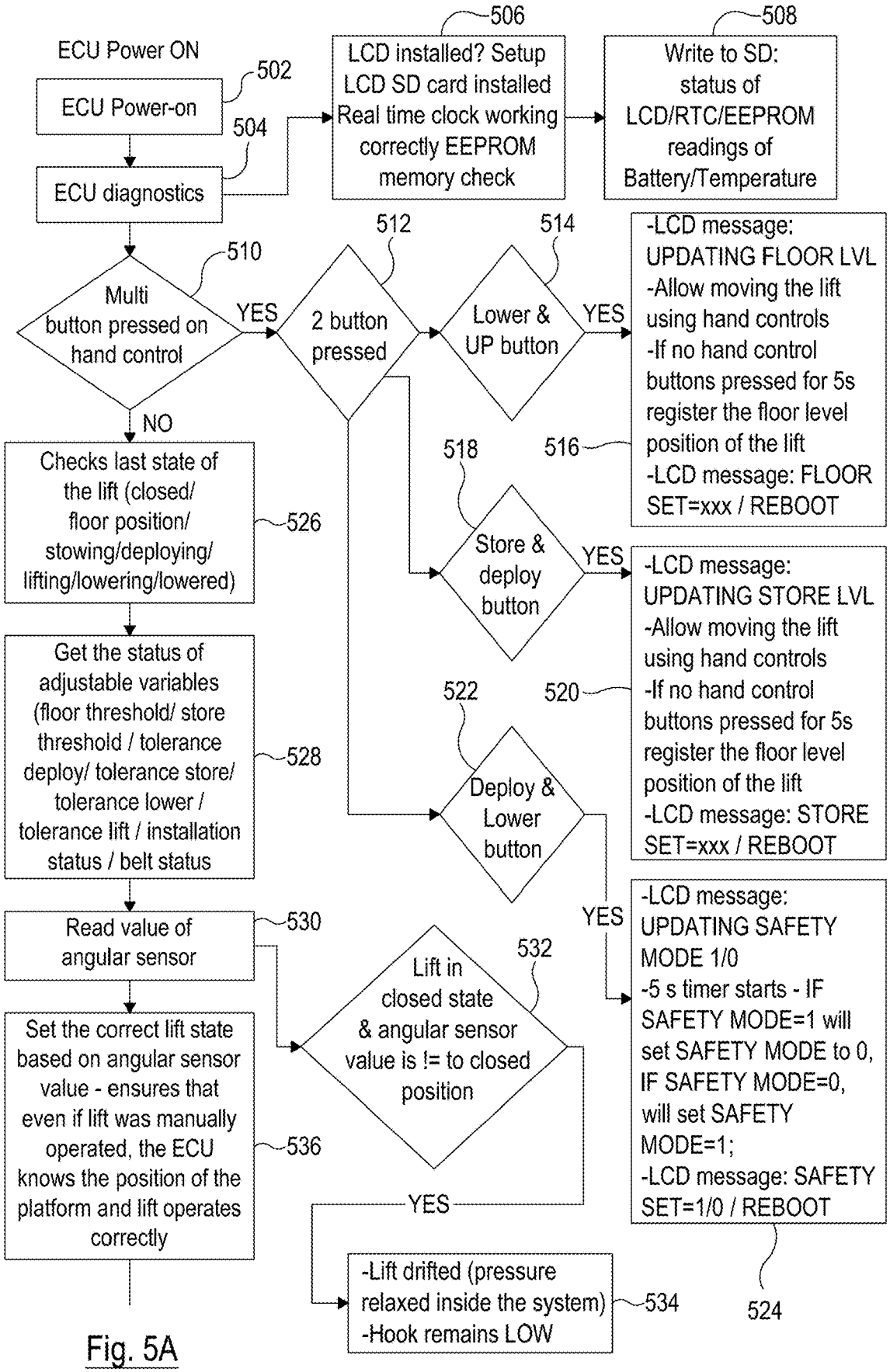
Figure 5B:
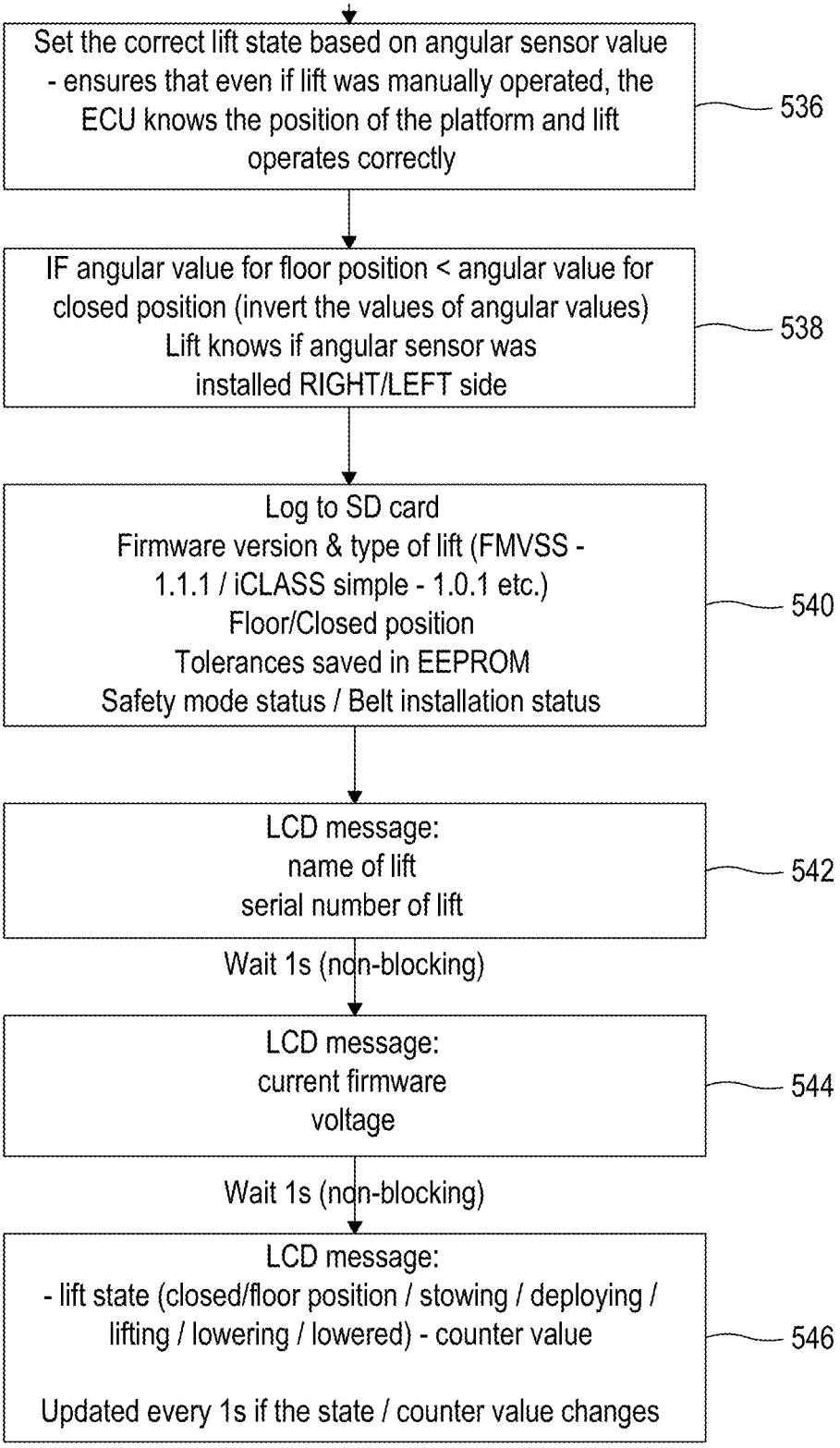

Some examples of possible operation of the ECU 74 will now be described with reference to the flow charts of FIGS. 5A to 9. It will be appreciated that in each of the operational sequences described one or more of the steps may be modified or omitted in other embodiments of the invention. Referring to FIG. 5A when the ECU 74 is powered on at step 502 it initiates a diagnostic and setup routine at step 504. First it checks at step 506 whether the LCD display 75 is installed and set up, checks that the SD card 80 is installed, checks that the clock 77 is functioning correctly and checks the EEPROM 78 is functioning. At step 508 the ECU then writes the status of the display 75, clock 77 and memory 78 to the SD card 80, as well as readings for voltage of the system battery (i.e. the vehicle battery) voltage and hydraulic fluid temperature.

Then, at step 510, the ECU checks for multiple buttons on the control module 84 being pressed simultaneously. If multiple buttons are pressed these may be arranged to calibrate the lift height sensor 58 and may arranged to allow the user to switch the system between its safety mode and fully functioning mode. If multiple buttons are determined as being pressed at step 510 then at step 512 the ECU determines whether exactly two buttons are being pressed. If two buttons are being pressed, then the ECU determines which two buttons are being pressed. If the ECU detects at step 514 that the lower 86 and up 88 buttons are being pressed, then at step 516 it generates a message which is displayed on the LCD display 75 to indicate that the floor level sensor reading is being updated. Thereafter it then is arranged to respond to the up and lower buttons 88 86 by raising and lowering the lift, allowing the user to move the lift to the floor level, i.e. level with the vehicle floor. Then if no buttons are pressed for 5 s the ECU records the reading from the lift height sensor 58 and registers that as the floor height reading of the sensor 58, and indicates this to the user by displaying a message FLOOR SET=xxx on the LCD display 75.

If the ECU determines at step 518 that two buttons that are pressed are the stow 90 and deploy 85 buttons then the ECU at step 520 generates a message which is displayed on the LCD display 75 to indicate that the store level sensor reading is being updated. Thereafter it then is arranged to respond to the up and lower buttons 88 86 by raising and lowering the lift and the store button 90 by moving the lift to the stored position, thereby allowing the user to move the lift to the stored position. Then if no buttons are pressed for 5 s the ECU records the reading from the lift height sensor 58 and registers that as the stored height reading of the sensor 58, and indicates this to the user by displaying a message STORE SET=xxx on the LCD display 75.

If the ECU determines at step 522 that the two pressed buttons are the deploy 85 and lower 86 buttons, then at step 524 it generates a display on the LCD display 75 UPDATING SAFETY MODE. If the ECU is in the safety mode it switches to the fully operational mode, and if it is in the fully operational mode it switches to the safety mode. Then it generates a display on the LCD SAFETY SET=1 (or 0) to indicate that the safety mode has been turned on (for off).

If on checking for the pressing of multiple buttons at step 510 the result is negative, then at step 226 the ECU checks at step 526 the last state of the lift, i.e. whether it was closed (stowed), at floor position, stowing, deploying, lifting, lowering or lowered. Then at step 528 the ECU gets the stored values of the adjustable variables, i.e. the values of the readings from the lift height sensor 58 which have been set as corresponding to the defined levels of the lift, as well as the tolerances on those readings as set by the user via the terminal device, the installation status of the lift and the status of the safety belt as last recorded from the safety belt sensor 64. Then at step 530 the ECU reads the current output value of the lift height sensor 58.

At step 532 the ECU determines if the lift is in the closed state and the current value of the lift height sensor 58 output is not equal to closed state value stored in memory, then at step 534 it is determined that the lift height has drifted, for example due to pressure relaxation in the hydraulic system, and the hook release signal is retained at LOW to retain the lift in the stowed position. A message may also be generated at this point for display on the LCD 85 to indicate that the hydraulic fluid pressure is low and the system needs checking.

If the lift height sensor output is at the expected level with the lift stowed, or if the lift is not stowed, at step 536 the ECU determines the current state of the lift and sets that by recording it in the EEPROM 78. This ensures that the ECU has the current state of the lift correctly stowed regardless of, for example, whether it has been manually operated since the ECU last recorded its state.

At step 538 the ECU compares the stored values of the lift height sensor output for the floor position and stowed position and from these determines which side of the lift the height sensor 58 is installed on. This is because the sensor will record clockwise rotation during raising of the lift if it is installed on one side of the lift, and anticlockwise rotation during raising of the lift if it is installed on the other side. With the sensor outputs for the stowed and floor level positions recorded, and the direction of rotation for raising and lowering of the lift determined, the ECU can accurately determine the height of the lift over the full range of lift height sensor outputs from stowed, through floor height, to lowered.

At step 540 the ECU records on the SD card the firmware version and lift type and the safety belt installation status which it has stored in memory as well as the current lift status and all of the lift position sensor reference values and tolerances and the safety mode status. At step 542 the ECU generates a message for display on the LCD display 75 indicating the name and serial number of the lift, then after is at step 544 it generates a further message for display indicating the current firmware voltage, and then finally at step 546 it generates a message for display indicating the current state of the lift, and that display is updated, for example once per second, if the state changes.

Another function which the ECU may perform is to count the number of cycles that the lift performs. Cycles may be defined in different ways, for example one cycle may be defined as completed when the moves from the floor level to ground level and back to floor level. Alternatively, or in addition, one cycle may be defined as completed when the lift moves from the stowed position to the deployed (floor level) position and back to the stowed position.

Figure 6:
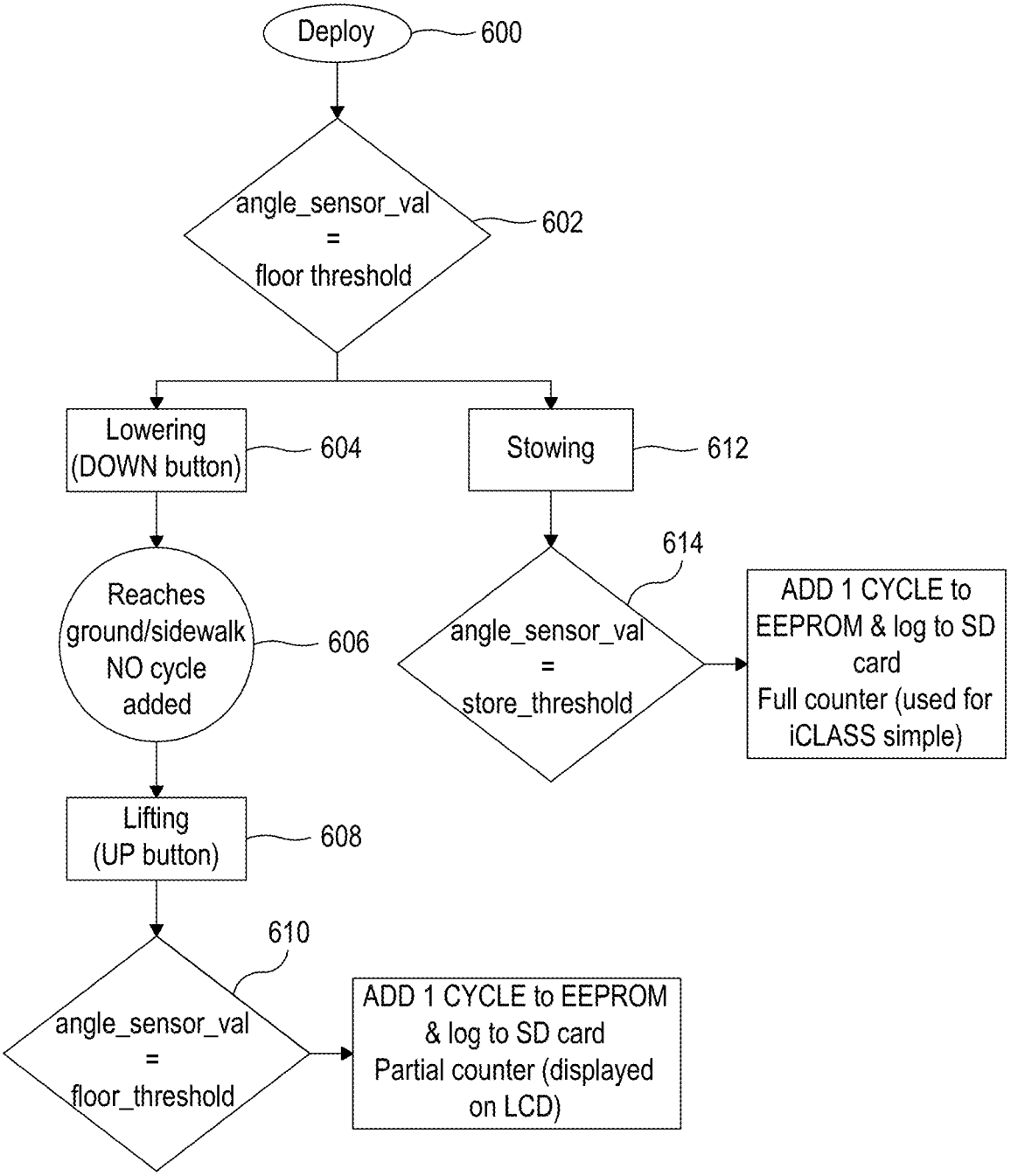
FIG. 6 is a flow diagram of a cycle counting operation of the system of FIGS. 1 to 4.

Referring to FIG. 6, a cycle counting process starts at step 600 when the lift is deployed, i.e. moved out of its stowed position. The ECU monitors the signal from the angular lift height sensor 58 until at step 602 it determines that the lift has reached the floor level state. From there the lift can either be stowed again, or lowered. If at step 604 the ECU determines that the lowering button 86 has been pressed, it then monitors the signal from the height sensor 58 until it determines at step 606 that the lift has reached ground level. If the ECU then detects at step 608 that the lifting button 88 is pressed and then at step 610 that the lift has returned to the floor level, the ECU increases by 1 the count of lifting cycles which is stored in the EEPROM 78 and also stores that increased count to the SD card, together with time at which the cycle is completed. If at any point the stow button 90 is pressed that is detected at step 612 and if subsequently the height sensor signal indicates at step 614 that the lift has returned to the stowed position, then the ECU increases by 1 the count of deploying cycles which is stored in the EEPROM 78, and also stores that on the SD card together with the time at which the cycle is completed.

The lift cycle count may be used in various ways. For example, once the cycle count reaches a predetermined number, such as 4500, the ECU may be arranged to generate a message for display on the LCD that the lift is due for a service. Alternatively, or in addition, when the cycle count reaches a predetermined number, which may be higher than the predetermined number mentioned above, for example 5000 cycles, if the lift has not been serviced, the ECU may be arranged to set the safety mode state to high switching the lift to the safety mode. This cycle count may be re-set via the app on the terminal device 100 when the lift is serviced.

Figure 7A:
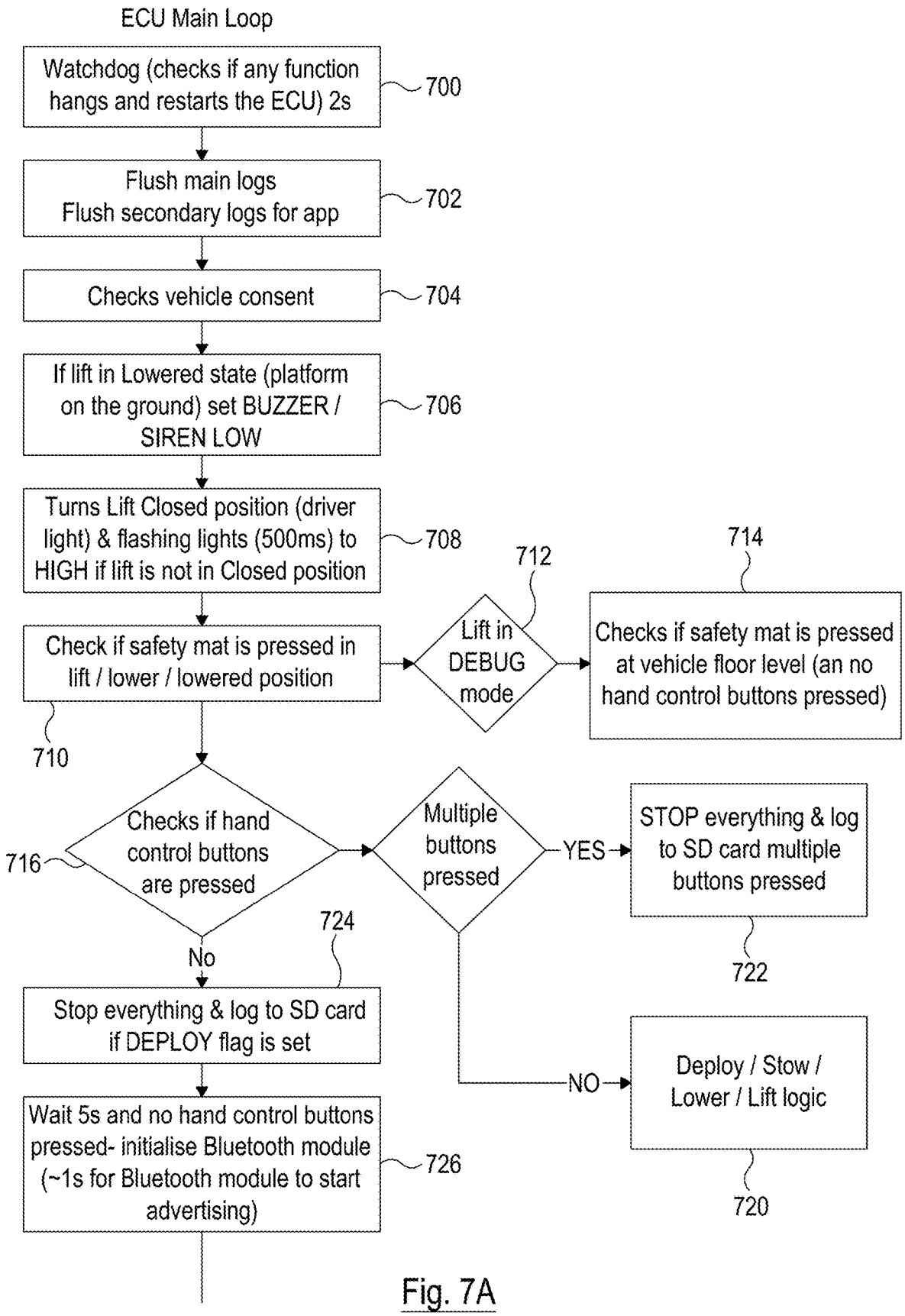
FIGS. 7A and 7B form a flow diagram of a main functional loop of the system of FIGS. 1 to 4.
Figure 7B:
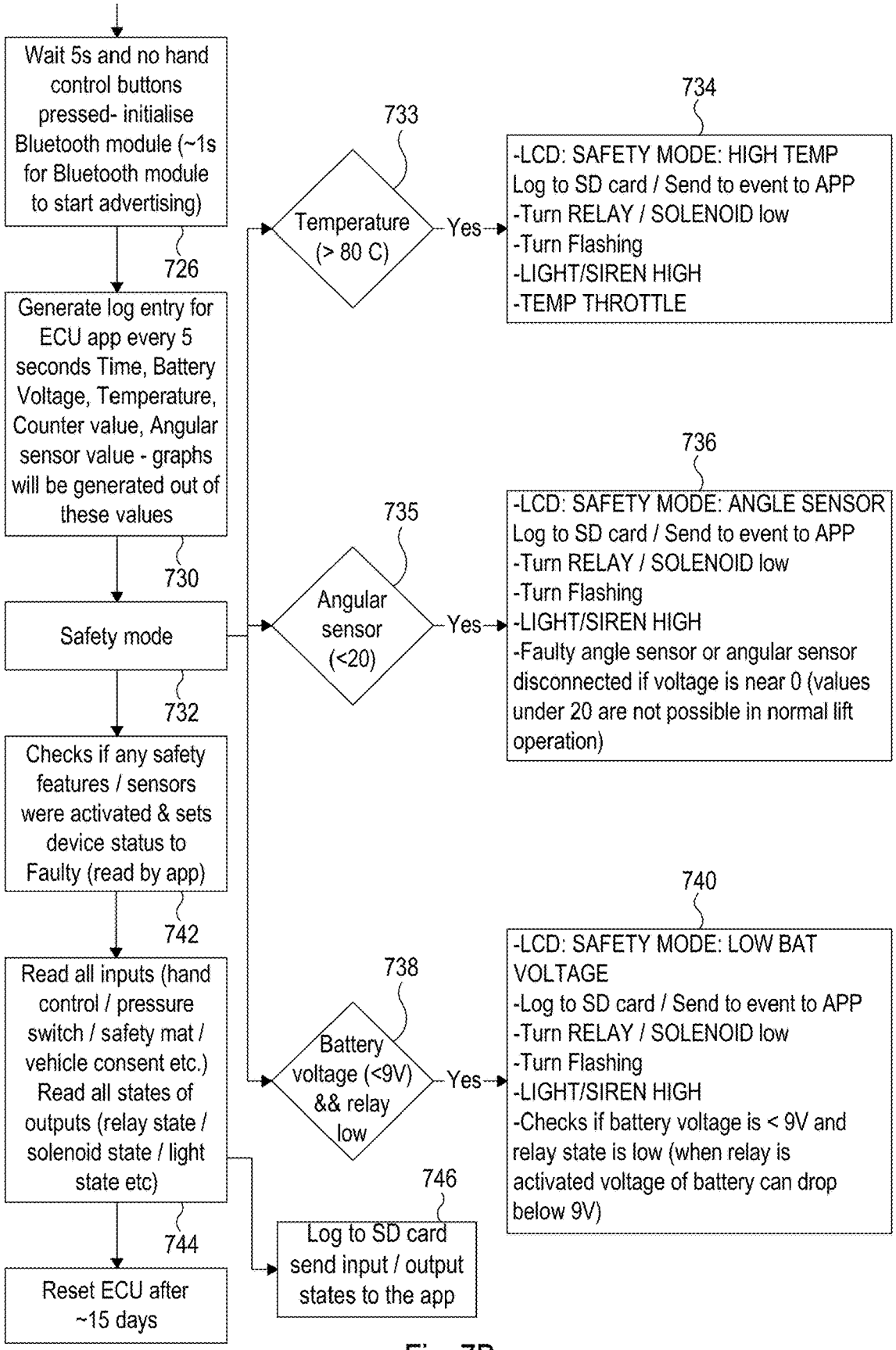

Referring to FIG. 7, the ECU also performs a main control loop in which the lift is operated and monitored, and in the event of various conditions being met, the system is switched between the fully functioning mode and the safety mode. At step 700 the ECU checks for any functions hanging for more than 2 s, and if that is detected indicating that the ECU has frozen in one state, the ECU restarts. If there is no hanging state detected at step 702 the ECU flushes all main and secondary logs, i.e. the records of all events and their time stamps recorded in the EEPROM, for the app, which includes saving all them to the SD card. Then at step 704 the ECU checks that consent conditions are met, by checking signals from one or more sensors on the vehicle which are required to be in the correct state for operation of the lift. For example this may include checking a signal from a handbrake sensor to check that the handbrake is on, or checking that the vehicle gearbox is in neutral. If the consent conditions are not met then the lift will not be moved. Then at step 706 the ECU checks whether the lift is in the lowered state, i.e. at ground level. If it is, then the ECU sets the buzzer or siren state to low, i.e. turns the buzzer or siren off. Then at step 708 the ECU checks whether the lift is in the stowed (closed) position. If it is not then the ECU sets the state of the control signal for the flashing light on the vehicle to high, i.e. turns on the flashing light to warn the driver that the lift is out of its stowed position. Then at step 710 the ECU checks whether the floor load sensor 22 switch is closed indicating the presence of a load on the vehicle floor near the lift while the lift is in the lowering, lifting or lowered state. If the ECU determines that the floor load sensor switch is closed then if the lift is in debug mode, which the ECU checks at step 712 then the ECU proceeds to check at step 714 whether the floor load sensor 22 switch is closed with the lift in the floor level state. This is to check the operation of the floor load sensor switch 22 in the factory and is not part of the normal operation of the lift.

At step 716 the ECU checks whether any of the control module buttons 85, 86, 88, 90 are pressed. If any of the control module buttons are pressed, then at step 718 the ECU checks whether more than one of the buttons are pressed. If not, i.e. if only one of the buttons is pressed, then the ECU proceeds to step 720 where it starts the operation corresponding to the one pressed button. If more than one of the buttons is pressed, then the ECU proceeds to step 722 and stops any operation of the lift and logs to the SD cards which of the buttons are pressed and the time at which that occurred. Then the ECU proceeds with the loop continuing to step 724.

If at step 716 the ECU determines that none of the control module buttons 85, 86, 88, 90 is pressed then it proceeds to step 724 at which, if a deploy flag is set, i.e. if the lift is in any state other than stowed, then the all operation of the lift is stopped. Then at step 726 the ECU waits for 5 s and if in that time still none of the buttons 85, 86, 88, 90 is pressed then the ECU initialises the wireless communication module so that it starts to advertise i.e. look for a suitable terminal device with which to communicate. If a suitable terminal is identified then the ECU proceeds with communication as described below with reference to FIG. 8. If not, then the ECU proceeds to step 730 where it generates a log entry, if 5 s has passed since the last log entry was generated, which includes the time, the vehicle battery voltage, the hydraulic fluid temperature, the cycle counter values(s) and the lift height sensor value. These logs are accumulated over time and communicated to the terminal device 100 whenever a communication link is made between the ECU and the terminal device 100.

Then at step 732 the ECU starts checks to determine whether it should enter the safety mode. At step 733 it checks the temperature of the hydraulic fluid from the signal from the temperature sensor 81. If the temperature is higher than 80 C then the ECU at step 734 switches to the safety mode, generates a message for display on the LCD display indicating that the safety mode has been entered and activates a warning to the user for example by illuminating the flashing light and turning on the siren, and sets the solenoid signal to low to close the valve 73 to prevent lowering of the lift and sets the relay signal to low to turn off the pump 72 and thereby stop raising of the lift.

At step 735 the ECU checks the output signal from the lift height sensor 58. If that value is outside a predetermined range, for example indicating that the voltage of the output signal is below a minimum threshold, then this is taken as an indication that the lift height sensor 58 is faulty. For example if the recorded value of the sensor output signal is below 20 then this may be taken as indicative of a fault, and the ECU at step 736 may activate the safety mode, setting the safety mode state to active, as well as recording that event to the SD card, generating a fault message for display on the LCD display 75 and activating the warning light and siren.

At step 738 the ECU checks the voltage of the vehicle battery to determine whether it is below a threshold value, for example 9V. If it is then the ECU proceeds to step 740 where it may activate the safety mode by setting the safety mode state to active, as well as recording that event to the SD card, generating a fault message for display on the LCD display 75 and activating the warning light and siren.

At step 742 the ECU checks any other sensors associated with safety features of the system, and if any of them indicates that the system is faulty then that is recorded.

At step 744 the ECU records the outputs from all of the system sensors and the recorded states of all components or functions of the lift system, such as the safety mode, any fault indications, and the positional status of the lift, as well as all indicators such as the siren and warning light, and at step 746 these are logged on the SD card.

Finally at step 748 if no inputs are received for a predetermined period, such as 15 days, then the ECU is reset so that when powered on it will return to the process of FIG. 5A.

Figure 8:
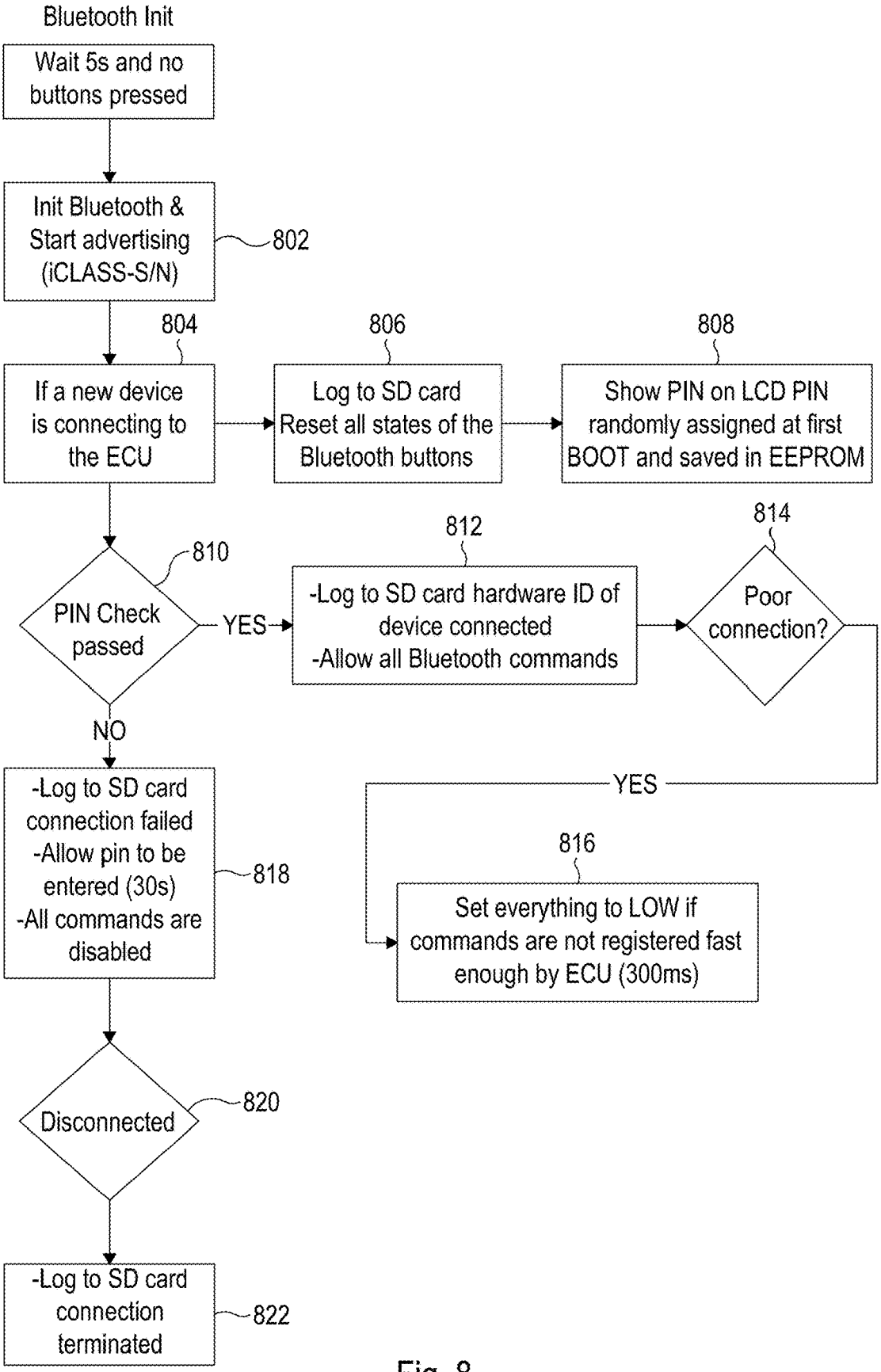
FIG. 8 is a flow diagram of a Bluetooth communication operation of the system of FIGS. 1 to 4.

Referring to FIG. 8, if during operation of the lift there is a delay of 5 s with no buttons being pressed, then the ECU is arranged at step 802 to seek to connect with any nearby terminal device 100 using the wireless communication protocol such as Bluetooth. Then at step 804, if a new device is detected and initiates a connection to the ECU then that is logged to the SD card, for example by logging the ID of the new terminal device and the time of connection, and at step 806 all states of the wireless connection recorded within the ECU are reset. The ECU then generates at step 808 a new PIN for the new terminal and displays that on the LCD display 75 and stores it in the EEPROM. The displayed PIN can then be read by the user of the new terminal device, who can then enter the PIN on the terminal device 100 which will be running the app to direct the user through the connection process. The device 100 then communicates the PIN to the ECU, and at step 810 the ECU checks the received PIN code. If it matches the stored PIN code for the new terminal device 100 then at step 812 the ECU stores the ID of the device 100 and the time of successful connection and then allows commands received from the terminal device 100 via the wireless connection to be implemented by the ECU. At step 814 if the ECU detects that the connection with the terminal device 100 is poor, for example if the data is received slowly or with missing data, then the wireless communication is set to a low speed rate at step 816.

If at step 810 the PIN received by the ECU is not correct then at step 818 the ECU records on the SD card that the connection failed and waits for a predetermined time, such as 30 s for the correct PIN to be received. If it is not, then all wireless connection commands are disabled, the ECU disconnects from the wireless communication at step 820 and logs to the SD card at step 822 that the connection has been terminated.

Figure 9:
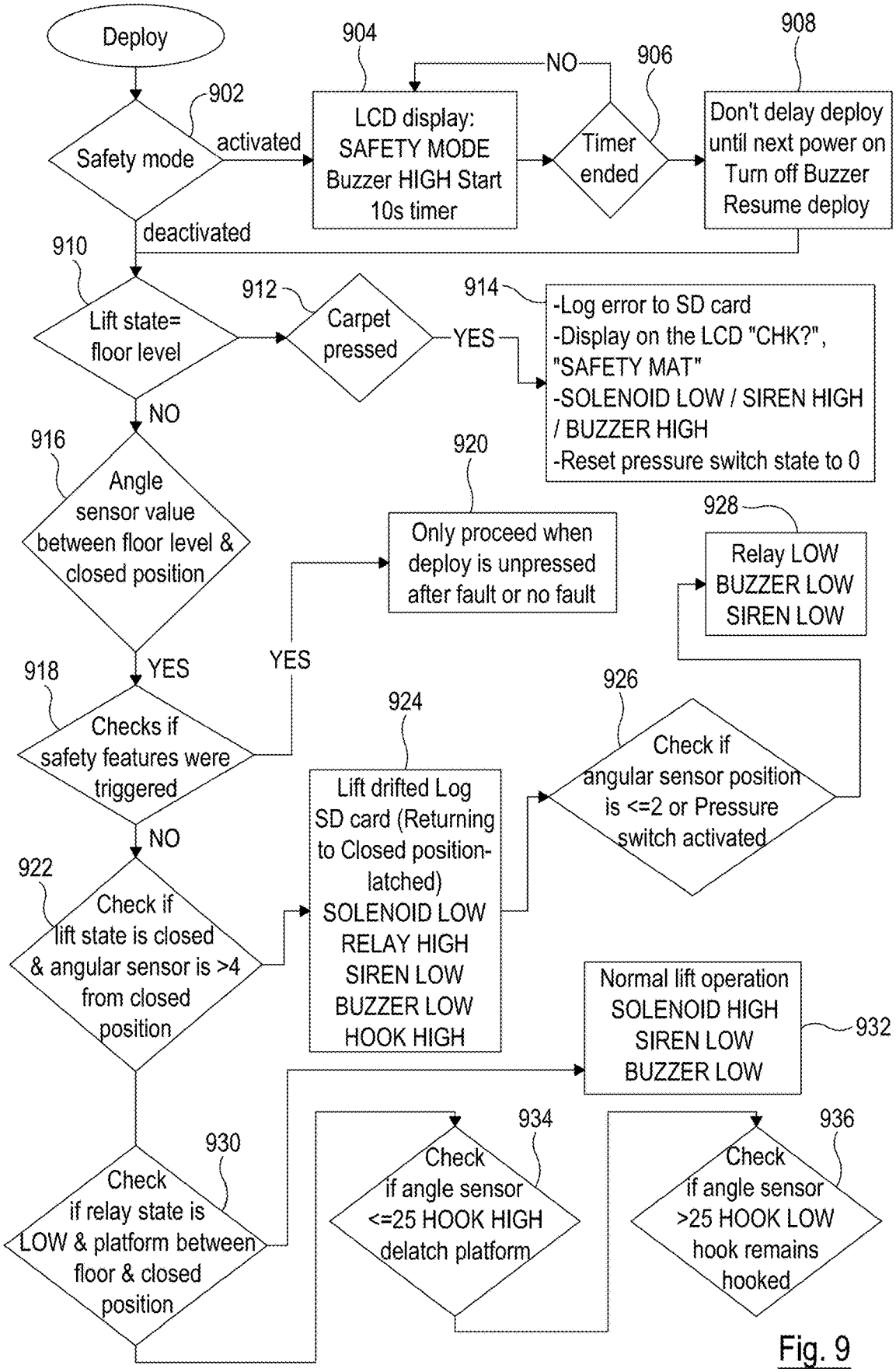
FIG. 9 is a flow diagram of a deploy operation of the system of FIGS. 1 to 4.

Referring to FIG. 9, if at step 720 of FIG. 7A the deploy button 85 is detected as pressed, then at step 902 the ECU checks whether the safety mode flag is set indicating that the ECU is to operate in the safety mode. If the safety mode flag is set, then the ECU proceeds to step 904 at which it generates a message for display on the LCD 85 to indicate that the safety mode is activated, activates an alarm such as a buzzer by setting an alarm activation signal to high, and starts a timer arranged to run for a delay period of, for example 10 s. Once that delay period has expired which is detected at step 906, the alarm is turned off at step 908, deploy operation of the lift is started, and is not delayed again until the lift is next powered up. If at step 902 the ECU determines that the safety mode is not activated, then it proceeds immediately with the deploy operation of the lift proceeds without delay. To start the deploy process at step 910 the ECU checks whether the lift is at floor level by checking the current state of the lift. If the lift is at floor level, then at step 912 the ECU checks whether the floor load sensor 22 is detecting a load on the vehicle floor in the area near the lift, and if it is then at step 914 this is recorded as an error on the SD card, the ECU generates a message for display on the LCD 85 to indicate that the floor load sensor is detecting a load, and activates an alarm such as a buzzer, and the solenoid control signal is set to low to prevent movement of the lift, and the pressure switch state is reset to zero to enable subsequent stowing of the lift as described below with reference to FIG. 10.

If at step 910 the ECU does not detect that the lift is at floor level, then at step 916 it checks from the lift level sensor that the lift is between the floor level and the fully closed position. If it is, then at step 918 the ECU checks that no faults are detected and no safety features are triggered. If they are it proceeds to step 920 where it waits until the fault is corrected or the safety critical condition resolved and the deploy button is released and re-pressed. If no faults or safety critical conditions are detected, or once they are corrected, at step 922 the ECU checks if both the current lift state is recorded as closed and the lift position sensor indicates that the lift is more than a predetermined distance away from the fully closed position. If both of those conditions are met then this indicates drift of the lift away from the fully closed position, and at step 924 the ECU logs to the SD card that drift has been detected, powers the pump 72 to return the lift to the fully closed position by setting the relay signal to high and sets the solenoid signal to low to prevent lowering of the lift, sets the buzzer signal to low to turn off the alarm and sets the hook signal to high to release the lift locking hook. Then at step 926 the ECU checks whether the output from the angular lift position sensor is less that a threshold low level, such as 2, indicating that it needs to be re-set, or the pressure switch is activated (pressure switch state set to 1) to indicate a fall in hydraulic pressure and if not, then at step 928 it sets the relay signal to low to turn off the pump 72 and turns off the buzzer and the siren.

If at step 922 the ECU determines that there has been no drift of the lift then at step 930 the ECU checks that the relay state is low i.e. that the pump is turned off, and that the platform is between the floor and closed positions, from the lift height position sensor signal, and if those conditions are met, then the ECU proceeds to step 932 where it lowers the lift by setting the solenoid signal to high to open the valve 73 and turning off the alarms. However if at step 930 the conditions for deploying the lift are not met, then the ECU is arranged to check at step 934 whether the lift is within a predetermined distance of fully closed, for example having a lift position signal value of less than 25 and if it is then the hook signal is set to high to release the lift from its stowed position so that lowering can start. Once the lift reaches a predetermined distance from the stowed position then at step 936 the hook release signal is returned to low to return the lift retaining hook to its closed position ready to engage the lift when it next returns to the closed position.

Once the lift is deployed then pressing the lower button 86 will cause the ECU to open the solenoid valve 73 to lower the lift, and pressing the up button 88 will cause the ECU to close the relay to activate the pump 72 to raise the lift. During raising or lowering the ECU is arranged to monitor the signals from the sensors to determine whether any safety features are activated. Each of the safety features is activated by a respective safety-critical condition. The safety critical conditions include the bridge plate or inner barrier being pushed away from its raised position, as detected by the sensor 52, the ramp or outer barrier 54 being pushed out of its raised position as detected by the sensor 56, the floor load sensor 22 detecting a load on the vehicle floor, the temperature sensor 81 detecting that the hydraulic fluid has reached a threshold temperature, and the pressure sensor 83 detecting that the hydraulic fluid pressure has fallen below a predetermined threshold pressure. If any one or more of these safety critical conditions occurs, then the associated safety feature is activated, which may mean that the movement of the lift is stopped and a warning issued to the user via the LCD 75 so that the user can check and remove the cause of the condition and re-start the operation of the lift.

As a further safety mechanism, the ECU 70 may be arranged to determine whether a predetermined number of safety feature triggers occur within a predetermined time, or within a predetermined number of lift cycles. For example three safety critical condition occurrences within one hour or one day, or within one lift cycle or three lift cycles. If this occurs then the ECU 70 may be arranged to switch to the safety mode, setting the safety mode status to high. The ECU may then also generate a message for display on the LCD to indicate that the system is faulty and that the safety mode has been activated.

Figure 10A:
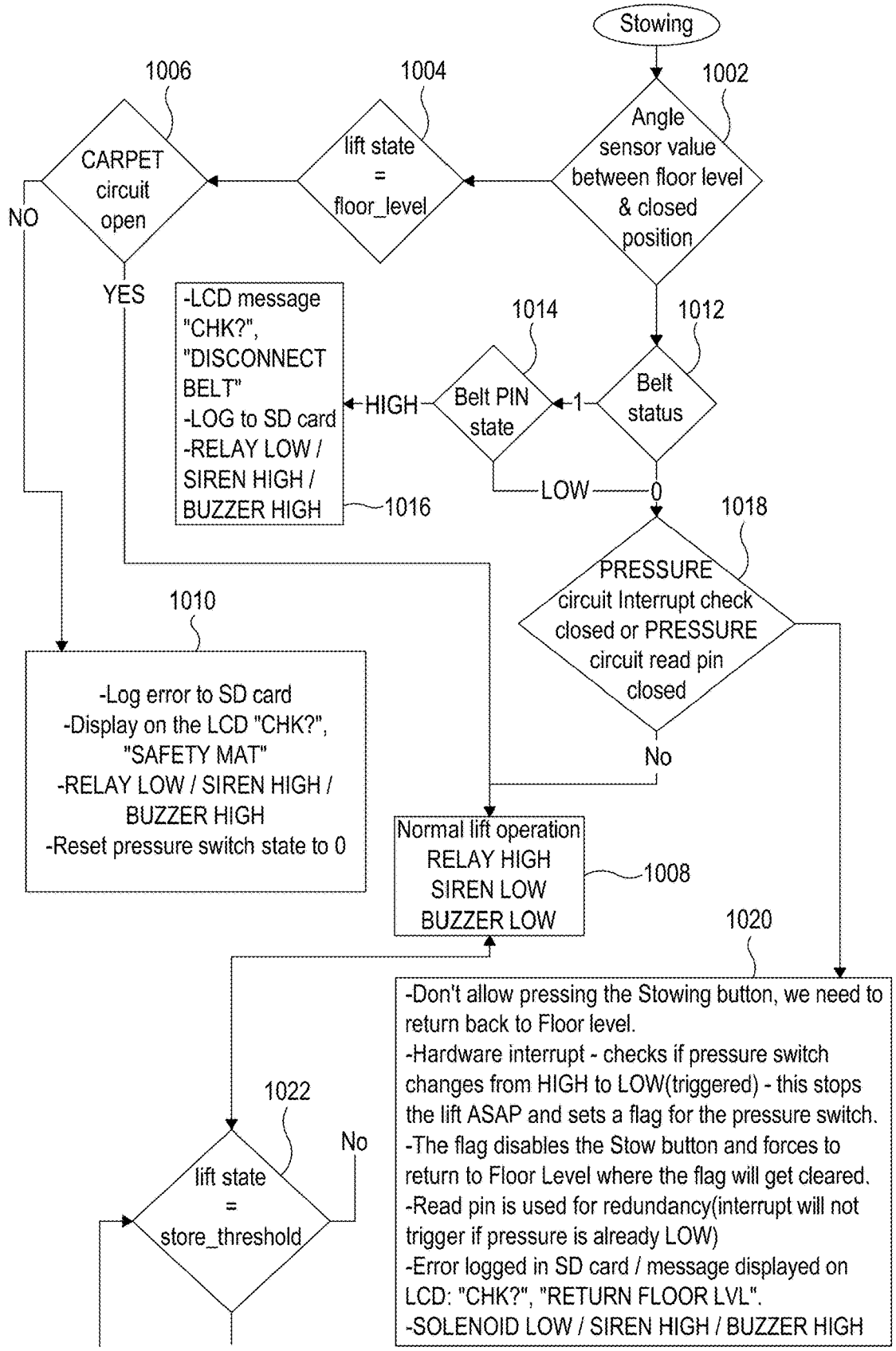
FIGS. 10A and 10B form a flow diagram of a stowing operation of the lift system of FIGS. 1 to 4.
Figure 10B:
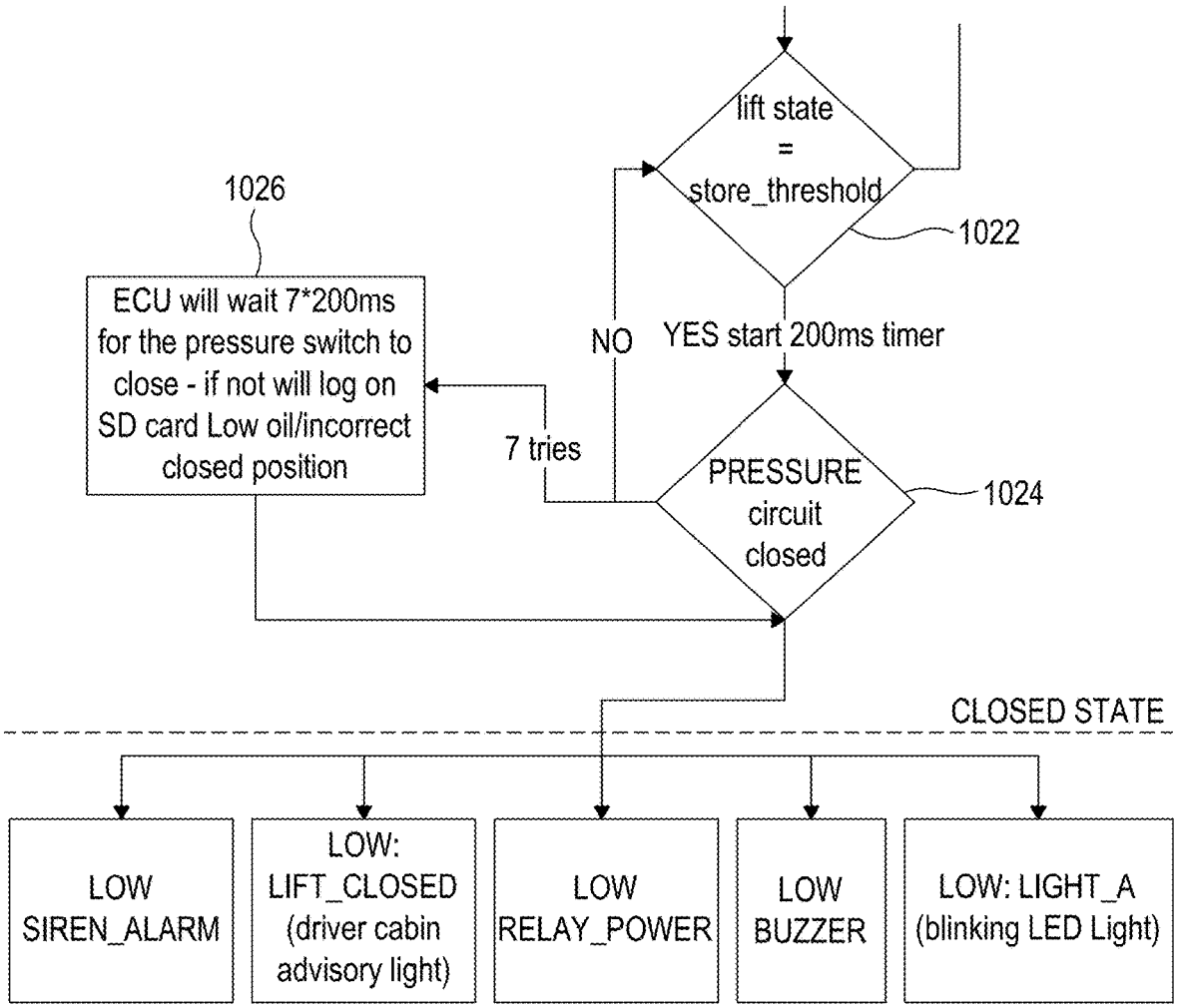

Referring to FIG. 10A, if the stow button 90 is pressed at step 720 of FIG. 7, then the stowing process of the lift is initiated. At step 1002 the ECU checks whether the lift height sensor output value is between the levels of floor level and the closed position, and if that is not then at step 1004 it checks whether the lift is at the floor level. If it is then the ECU checks the floor load sensor 22 output signal at step 1006 and if that does indicate a load on the vehicle floor this indicates that the bridge plate 40 is lowered, as expected, and the ECU moves to step 1008 where the relay is closed to power the pump to start to stow the lift, and the siren and buzzer are turned off.

If at step 1006 the floor load sensor does not detect the lowered bridge plate, then at step 1010 the ECU logs an error to the SD card, generates a message for display on the LCD indicating a possible error with the floor load sensor or bridge plate, sets the relay control signal to low to stop raising of the lift, activates the buzzer and resets the pressure sensor flag state to 0.

If at step 1002 the ECU determines that the lift is between the floor level and stowed positions, then it moves to step 1012 and checks the status of the safety belt from the signal from the safety belt sensor 64. If safety belt status indicates that the belt is fastened then at step 1014 it checks whether the belt flag (or pin) state is set to high or low. If it is set to high then this indicates that the belt is fastened so at step 1016 the stowing is stopped and the ECU generates a message for display on the LCD 85 indicating that the belt should be checked. The buzzer and siren are also activated.

If at step 1012 the belt is not detected as secured, or if at step 1014 the flag indicates that the belt status signal is to be overridden, then at step 1018 the ECU checks whether either the pressure sensor signal indicates that the fluid pressure is above a predetermined threshold, or the pressure sensor flag is set to 1, then this is taken as an indication that there is a load on the lift platform and the stowing process is stopped. Then at step 1020 the ECU generates a message for display on the LCD saying that the lift should be checked for a load and returned to floor level. The reason for this is that, if the stowing is re-started the hydraulic pressure will initially be lower than when it is part way through the stowing process, and so even if a load is present in the platform, the lift will start to stow before the hydraulic pressure rises to such a level as to stop it. The use of the fluid pressure flag means that if at any point during stowing a load is detected on the platform by the pressure sensor, the lift has to be returned to floor level to clear the fluid pressure flag before stowing can be completed.

If at step 1018 the pressure sensor flag is not set high and the pressure sensor does not sense a pressure above the threshold, then the ECU proceeds to step 1008 to stow the lift.

At step 1022 the ECU checks whether the lift has reached the stowed position. If not then the ECU again checks whether the stow button is pressed, and if it is returns to step 1002. If at step 1002 the lift has reached the stowed position, then the ECU waits for a predetermined period, for example 200 ms, and then checks at step 1024 whether the fluid pressure has exceeded the threshold indicating that the lift is being stopped from further movement because it has reached the stowed position. If it has, then the lift state is changed to closed. If it does not, then the ECU repeats the wait and the check on the fluid pressure. If the fluid pressure indicates that the lift has reached the stowed position within seven cycles of waiting and checking then the lift state is changed to closed. If after seven checks the fluid pressure still does not reach the threshold, then at step 1026 this is recorded on the SD card as an indication that the hydraulic fluid level is low or the value of the lift position sensor recorded as indicative of the lift being stowed is incorrect.

Once the stowed (closed) state is reached, the ECU takes a number of appropriate steps, for example turning off the alarm siren, turning off the cabin advisory light which indicates when the lift is in use, opening the pump relay to turn off the pump, turning off the buzzer and turning off the flashing LED light.

Prior to normal operation as described above, when lift has first been installed in the vehicle, it is arranged to operate initially in the safety mode, and only to switch to the fully operational mode once a number of checks have been performed. These checks may include comparing the signals from one or more of the sensors against stored reference values to check that the sensors are functioning properly and/or that the various components of the lift are in the correct positions. The checks may also be capable of being initiated only via a suitable terminal device 100 which is running the appropriate application once the device has been paired with the lift ECU via the wireless connection. For example the ECU may be arranged to check any one or more of the following: that the signal from the fluid temperature sensor 81 is within a predetermined range, that the signal from the fluid pressure sensor 83 is within a predetermined range, that the signal from the sensor 56 for the ramp 54 is within a predetermined range, that the signal from the sensor 52 for the bridge plate is within a predetermined range, that the control signal for the operation light is functioning, that the control signal to for the warning light is functioning, that the output signal from the lift height sensor 58 is within a predetermined range, and that the signal value recorded for the lift being at floor height is within a predetermined range. The results of these checks may be communicated by the ECU to the terminal 100 where they can be displayed to the user who is installing the lift, for example as a colour coded display icon for each of the checks. If all of these checks are successful then the ECU may then be arranged to set the safety mode state to low to switch the lift from the safety mode to the fully operational mode. This may be done automatically by the ECU on completion of the checks, or it may only be done in response to a user input to the terminal device 100 which is prompted by the app, for example by displaying a request for confirmation of completion of the installation process on the terminal device 100, and communicated to the ECU to trigger the switch to the fully operational mode.

A further feature of the app installed on the terminal device 100 is that it may be arranged to pair the device 100 with the control units of several different lifts, each of which may be as shown in FIGS. 1 to 4 and installed on a respective vehicle, so that, for example, it can be used by a fleet manager to monitor the operation of all of the lifts in a fleet of vehicles. Each time the device 100 is paired with an ECU 70 for one of the lifts in the fleet, the user (fleet manager) will be able to enter the PIN for that ECU into the device 100, and the app will download the latest data from the SD card of that lift, and can display that data for checking by the fleet manager. The display may take any suitable form, and could for example be a single message or icon indicating that the lift is functioning correctly if no faults are recorded for that lift, or it could be a set of icons each indicating the status of a respective component of the lift system. This enables the fleet manager to quickly check all of the lifts in the fleet, for example once a day, to ensure that they are fault free and fully operational.

The invention claimed is:

1. A wheelchair lift system for a vehicle, the system comprising:

a lift, the lift comprising a platform for accommodating a wheelchair, a lifting arm, and a barrier mounted on the platform and pivotable between a raised position and a lowered position;

a hydraulic circuit including a hydraulic actuator arranged to act on the lifting arm to raise and lower the platform;

a plurality of sensors each arranged to generate a sensor output;

a user input device arranged to generate control signals to control operation of the lift; and a control unit; wherein the control unit is arranged to receive the control signals and to receive the sensor output from each of the sensors and to control the hydraulic circuit thereby to control of the lift to perform a number of different operations;

the control unit is operable in a fully operational mode and a safety mode and is arranged to perform a plurality of checks on the sensor outputs to generate a result of each of the checks, and to record each of the results, and to switch between the fully operational mode and the safety mode based on the results, wherein the control unit is arranged to initiate a first one of the operations of the lift in response to a first one of the control signals in both the fully operational mode and the safety mode, but to control the lift system to perform said one of the operations at a first rate when in the control unit is in the fully operational mode and at a second rate when the control unit is in the safety mode, and the second rate is slower than the first rate, wherein said first one of the operations comprises one of: raising the lift, lowering the lift, stowing the lift, and deploying the lift.

2. A wheelchair lift system according to claim 1 wherein the control unit is arranged to introduce a delay in performance of said first one of the operations only when the control unit is in the safety mode.

3. A wheelchair lift system according to claim 1 wherein the control unit is arranged to default to the safety mode, to perform a set of checks on the sensor outputs, and only switch to the fully operational mode in response to checks indicating no faults.

4. A wheelchair lift system according to claim 1 wherein the control unit is arranged to monitor the sensor outputs during operation of the lift in the fully operational mode, and to switch to the safety mode if the sensor outputs indicate the presence of at least one system fault, and the control unit is further arranged to store in memory as fault record data each detection of a system fault and the time of that detection.

5. A wheelchair lift system according to claim 1 wherein the hydraulic circuit contains hydraulic fluid, and one of the sensors is arranged to measure at least one of the pressure and the temperature of the hydraulic fluid.

6. A wheelchair lift system according to claim 1 wherein the lift has a current height and one of the sensors is a lift height sensor arranged to measure the current height.

7. A wheelchair lift system according to claim 1 wherein the control unit is arranged to monitor the sensor outputs during operation of the lift, to detect from the sensor outputs the occurrence of the safety critical condition, and in response to detection of a safety critical condition, to prevent movement of the lift, wherein the safety critical condition comprises one of: movement of a barrier of the lift, the presence of a load on the floor of the vehicle, and the presence of a load on the lift platform.

8. A wheelchair lift system according to claim 7 wherein one of the control signals is a further control signal, and, after detection of a safety critical condition, the control unit is arranged to enable movement of the lift only after receiving the further control signal from the user input and detecting an absence of the safety critical condition.

9. A wheelchair lift system according to claim 1 wherein the control unit is arranged to define a plurality of states of the lift system and to determine which of the states the lift is in depending on the sensor outputs and control inputs, to record the current state of the lift system, and to record in memory as state data each change of state of the lift and the time of each such change of state.

10. A wheelchair lift system according to claim 1 wherein the control unit is arranged to record in memory a count of operational cycles of the lift, to detect from the sensor outputs each time that the lift completes an operational cycle, and in response to completion of an operational cycle to update the recorded count of lift cycles.

11. A wheelchair lift system according to claim 10 wherein the control unit is arranged to switch to the safety mode in response to the recorded count reaching a predetermined number.

12. A wheelchair lift system for a vehicle, the system comprising:

a lift, the lift comprising a platform for accommodating a wheelchair, a lifting arm, and a barrier mounted on the platform and pivotable between a raised position and a lowered position;

a hydraulic circuit including a hydraulic actuator arranged to act on the lifting arm to raise and lower the platform;

a plurality of sensors each arranged to generate a sensor output;

a user input device arranged to generate control signals to control operation of the lift; and a control unit; wherein the control unit is arranged to receive the control signals and to receive the sensor output from each of the sensors and to control the hydraulic circuit thereby to control of the lift to perform a number of different operations;

the control unit is operable in a fully operational mode and a safety mode and is arranged to perform a plurality of checks on the sensor outputs to generate a result of each of the checks, and to record each of the results, and to switch between the fully operational mode and the safety mode based on the results, the system further comprising a terminal device wherein the control unit and the terminal device are arranged to establish a wireless communication link between them, the terminal device is arranged to receive from the control unit data stored in memory by the control unit and the terminal device is arranged to transmit control signals to the control unit whereby the terminal device can act as the user input device; and wherein the control unit is further arranged to store in memory as fault record data each detection of a system fault and the time of that detection; the terminal device is arranged to:

receive the fault record data from the control unit and to generate based on the fault record data a display indicating the presence or absence of recorded faults;

transmit to the control unit a control input arranged to switch the control unit from the safety mode to the fully operational mode;

transmit to the control unit a control settings input arranged to change at least one operational setting of the lift system; and establish wireless communication with a further control unit of a further wheelchair lift to enable a user to monitor and/or operate a plurality of wheelchair lifts using a single terminal device.

13. A wheelchair lift system for a vehicle, the system comprising:

a lift, the lift comprising a platform for accommodating a wheelchair, a lifting arm, and a barrier mounted on the platform and pivotable between a raised position and a lowered position;

a hydraulic circuit including a hydraulic actuator arranged to act on the lifting arm to raise and lower the platform;

a plurality of sensors each arranged to generate a sensor output;

a user input device arranged to generate control signals to control operation of the lift; and a control unit; wherein the control unit is arranged to receive the control signals and to receive the sensor output from each of the sensors and to control the hydraulic circuit thereby to control of the lift to perform a number of different operations;

the control unit is operable in a fully operational mode and a safety mode and is arranged to perform a plurality of checks on the sensor outputs to generate a result of each of the checks, and to record each of the results, and to switch between the fully operational mode and the safety mode based on the results;

wherein the hydraulic circuit contains hydraulic fluid, the control unit is arranged, during stowing of the lift, to monitor a pressure of the hydraulic fluid if the pressure exceeds a threshold value to stop the stowing of the lift and to set a pressure sensor flag, and thereafter only to enable stowing of the lift if the pressure sensor flag is cleared; and wherein the control unit is arranged to clear the pressure sensor flag only on returning of the lift to the vehicle floor level.

14. A wheelchair lift system for a vehicle, the system comprising:

a platform for accommodating a wheelchair;

a lifting arm;

a hydraulic circuit including a hydraulic actuator arranged to act on the lifting arm to raise and lower the platform;

a barrier mounted on the platform and pivotable between a raised position and a lowered position;

a plurality of sensors each arranged to generate a sensor output;

a user input device arranged to generate control signals to control operation of the lift;

a control unit; and a terminal device;

wherein the control unit and the terminal device are arranged to establish a wireless communication link between them, the terminal device is arranged to receive from the control unit fault data stored in memory by the control unit and indicative of a fault in the lift system, and the terminal device comprises a display and is arranged to control the display to indicate to a user the presence of the fault in the lift system; and wherein the terminal unit is arranged to establish wireless communication with at least one further control unit of at least one further lift system whereby it can control the display to indicate the presence of a fault in any one of a plurality of lift systems.

* * * * *